US010015854B2

(12) United States Patent
Hilgers et al.

(10) Patent No.: US 10,015,854 B2
(45) Date of Patent: Jul. 3, 2018

(54) LED DRIVER CIRCUIT, LED CIRCUIT AND DRIVE METHOD

(71) Applicant: PHILIPS LIGHTING HOLDING B.V., Eindhoven (NL)

(72) Inventors: Achim Hilgers, Eindhoven (NL); Yuanqiang Liu, Eindhoven (NL); Harald Josef Gunther Radermacher, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/328,070

(22) PCT Filed: Jul. 22, 2015

(86) PCT No.: PCT/EP2015/066804
§ 371 (c)(1),
(2) Date: Jan. 23, 2017

(87) PCT Pub. No.: WO2016/012522
PCT Pub. Date: Jan. 28, 2016

(65) Prior Publication Data

US 2017/0208660 A1 Jul. 20, 2017

(30) Foreign Application Priority Data

Jul. 23, 2014 (WO) ..... PCT/CN2014/082842
Oct. 3, 2014 (EP) ..... 14187660

(51) Int. Cl.
*H05B 33/08* (2006.01)

(52) U.S. Cl.
CPC ..... *H05B 33/0845* (2013.01); *H05B 33/089* (2013.01); *H05B 33/0815* (2013.01)

(58) Field of Classification Search
CPC ..... H05B 33/0845; H05B 33/0815; H05B 33/089
(Continued)

(56) References Cited

U.S. PATENT DOCUMENTS 7,605,550 B2 10/2009 Ferentz et al.
2007/0182338 A1 8/2007 Shteynberg et al.
(Continued)

FOREIGN PATENT DOCUMENTS

EP 2590477 A1 5/2013
EP 2618636 A1 7/2013
(Continued)

*Primary Examiner* — Daniel D Chang
(74) *Attorney, Agent, or Firm* — Akarsh P. Belagodu

(57) ABSTRACT

A driver circuit for driving an LED arrangement (22), comprising: a power source for providing the LED arrangement with a regulated driving current, said converter (20) being adapted to convert an dimmed input power into said driving current; a current sensing element (42) in series with the LED arrangement (22) and adapted to sense the LED arrangement current through the LED arrangement (22); a bleeder circuit (40) having a bleeding path connected in parallel with the LED arrangement, adapted for removing a bleed portion from the driving current so as to decrease the output power of the LED arrangement; and a control circuit for enabling said bleeder circuit when the LED arrangement current sensed by the current sensing element is below a threshold so as to further dim the LED arrangement down.

14 Claims, 31 Drawing Sheets

(58) Field of Classification Search
USPC ..... 315/127
See application file for complete search history.

(56) References Cited

U.S. PATENT DOCUMENTS

| | | | | |
|---|---|---|---|---|
| 2007/0182347 | A1 | 8/2007 | Shteynberg et al. | |
| 2011/0068706 | A1* | 3/2011 | Otake ..... | H05B 33/0815 315/291 |
| 2011/0140620 | A1 | 6/2011 | Lin et al. | |
| 2011/0234115 | A1 | 9/2011 | Shimizu et al. | |
| 2011/0291583 | A1 | 12/2011 | Shen | |
| 2012/0319621 | A1 | 12/2012 | Sutardja et al. | |
| 2013/0106298 | A1 | 5/2013 | Datta et al. | |
| 2014/0001979 | A1 | 1/2014 | Mercier et al. | |
| 2014/0049174 | A1 | 2/2014 | Radermacher et al. | |
| 2014/0111105 | A1 | 4/2014 | Chen et al. | |
| 2014/0265888 | A1 | 9/2014 | Ekbote | |

FOREIGN PATENT DOCUMENTS

| | | | |
|---|---|---|---|
| WO | 2005115058 | A1 | 12/2005 |
| WO | 2011013060 | A2 | 2/2011 |
| WO | 2011045371 | A1 | 4/2011 |
| WO | 2011114261 | A1 | 9/2011 |
| WO | 2013064960 | A1 | 5/2013 |
| WO | 2014091356 | A2 | 6/2014 |

* cited by examiner

LED DRIVER CIRCUIT, LED CIRCUIT AND DRIVE METHOD

CROSS-REFERENCE TO PRIOR APPLICATIONS

This application is the U.S. National Phase application under 35 U.S.C. § 371 of International Application No. PCT/EP2015/066804, filed on Jul. 22, 2015, which claims the benefit of Chinese Patent Application No. PCT/CN2014/082842, filed on Jul. 23, 2014 and European Patent Application No. 14187660.7, filed Oct. 3, 2014. These applications are hereby incorporated by reference herein.

FIELD OF THE INVENTION

This invention related to LED-based lighting, and in particular which is compatible with dimmer switches originally designed for other lighting technologies, such as incandescent lighting.

BACKGROUND OF THE INVENTION

LED-based (retrofit) lamps are used more and more in home buildings and offices. Besides their high efficiency they attract consumers also due to new design features, different color temperatures, diming ability etc.

If LED lamps are connected to already installed/existing dimmers they need to be compatible to these dimmers, i.e. they need to cope with the high oscillations generated by the dimmer during the phase edges/cuts and to guarantee a minimum holding current during the whole cycle of the (phase cut) mains voltage. Finally, as a function of the conducting angle the LED lamp needs to reduce its optical output as a result of a lower operation current.

Currently, about 90% of installed phase cut dimmers worldwide are of leading edge or trailing edge types. These dimmers cut a part of the mains voltage, either at the beginning of the sinusoidal voltage (leading edge) or at the end of the sinusoidal voltage (trailing edge) and thus reduce the time energy is fed to the connected driver electronics.

In order to guarantee a proper operation, a minimum holding current of the electronic switch in the dimmer (which is typically a triac) needs to be drawn by the connected electronics through the whole cycle of the supplied mains voltage, even for the lowest dimming settings. However, at various times modern LED driving electronics needs only a low amount of current. For example a non-constant current may be drawn by the electronic circuit, for example with a higher current drawn at the beginning of the mains cycle and less during the remaining time of this cycle. Low wattage LED packages of course need a low current. If the efficiency of higher power LED packages increases further, then even high power LED packages may have low current requirements. US20120319621A1 and other prior arts disclose various solutions to make the dimmer happy: namely meet the dimmer's requirement on the minimum latch current. Their basic solution is when the load current is too small to keep the dimmer operating, an extra current is drawn from the dimmer to make the dimmer output current above its minimum latch current.

Usually at a dimmed state the LED converter (which consists of a driver circuit and a ballast circuit) delivers too much power to the LEDs, resulting in still rather high light outputs, even at small conducting angles of a phase cut dimmer. In order to compensate for this, surplus power delivered by the converter needs to be converted, typically to heat, by means of so-called bleeder constructions.

The applicant has proposed (but not yet published at the priority date of this application) a bleeder approach which comprises a circuit located on the LED board (a so-called level 2 bleeder), where sufficient heat spreading possibilities are available since the LEDs run at a lower wattage during dimming.

The aim of the bleeder construction is to allow deeper dimming levels. The proposed system draws a constant current when the bleeder function is active, so that the sum of LED current and bleed current stays constant.

SUMMARY OF THE INVENTION

Bleeder constructions can however result in increased flicker at low driving levels.

There is therefore a need for a bleeder configuration which allows deep dimming levels while suppressing flicker problems.

The invention is defined by the claims.

According to the invention, there is provided a driver circuit for driving an LED arrangement, comprising:

a power source for providing the LED arrangement with a regulated driving current, said converter being adapted to convert an dimmed input power into said driving current;

a current sensing element in series with the LED arrangement and adapted to sense the LED arrangement current through the LED arrangement;

a bleeder circuit having a bleeding path connected in parallel with the LED arrangement, adapted for removing a bleed portion from the driving current so as to decrease the output power of the LED arrangement; and a control circuit for enabling said bleeder circuit when the LED arrangement current sensed by the current sensing element is below a threshold so as to further dim the LED arrangement down.

The bleeder circuit is able to drain surplus power, for example from an output of the power source, so that deep dimming is made possible. Thus, the invention enables real deep dimming of LED-based lamps with very low flickering. Usually at a dimmed state the LED converter (driver/ballast) delivers too much power to the LEDs, resulting in rather high light output, even at small conducting angles for the example of a phase cut dimmer. In order to compensate for this, surplus power delivered by the converter needs to be converted by means of a bleeder construction. A big difference of the driver circuit over the prior art is that the bleeder circuit draws current from the LED arrangement so as to further dim it down, while in the prior art the bleed current is drawn from the dimmer, not from the load thereby the load current is not modified.

The advantage of the circuit of the invention is that it allows a driver to reach even deeper dimming levels with even lower flickering. For example this may smooth the discharge curve of the LED smoothing capacitor. In addition, since fewer components are required the circuit reduces the necessary board space and offers cost benefits over a constant current approach. The circuit can also show an almost perfect temperature stability.

In one embodiment, the power source may comprise:

a switched mode power converter receiving an input signal which comprises a rectified mains power signal to which a dimming function has been applied, said switched mode power converter is adapted to convert the input signal into said driving signal;

wherein the switched mode power converter optionally comprises a ringing choke converter.

This embodiment provides the integration of embodiment of the invention with a low cost converter, such as a ringing choke converter ("RCC"), with low component count. This embodiment has the advantages of low cost.

In one further embodiment, the rectified mains power may be a phase cut signal applied with said dimming function, the driving signal is synchronized in phase with the rectified mains power, and the bleeder circuit comprises a switching arrangement which is adapted to switch in dependence on either the phase of the rectified mains power or the phase of the driving signal, thereby to modulate the current in the bleed path.

The switching can be used to connect components into circuit or disconnect components, thereby to influence the size of the bleed current portion. Since in a ringing choke converter the driving signal is synchronized in phase with the rectified mains power, the bleeder circuit can obtain the phase of active or passive powering by either detecting the driving signal or the input phase-cut mains power.

In one further embodiment, the bleeder circuit may comprise:

a first branch which comprises:

a current bleed branch in parallel with said LED arrangement; and the current sensing element comprises a sense resistor arrangement having an output which connects to the LED arrangement and to the current bleed branch, wherein the sense resistor is adapted to sense the driving current and adapted to adjust the bleed portion of the current bleed branch according to the driving current, and the bleeder circuit further comprises:

a current setting branch, for setting the bleed portion of the driving signal that is bled by the current bleed branch;

wherein the current bleed branch and the current setting branch form a current mirror. and wherein the bleed portion of the driving current is dependent on the ratio between an emitter resistance of the current setting branch and an emitter resistance of the current bleed branch in the current mirror.

This bleeder circuit sets the combined bleed current portion and current setting portion (which passes to the LED). It may enable a self-activated bleeder circuit which only operates when the LED current drops below a threshold. Also, using current mirror can obtain accurate current control of the bleeder circuit.

Given the above bleeder circuit, the bleeder circuit further comprises:

a resistance tuning circuit coupled to either of the current setting branch and the current bleed branch and adapted to adjust the emitter resistance of the coupled branch, thereby achieving a high bleed current or a low bleed current according to the phase of the driving current or the phase of the rectified mains power into the power source.

One aspect is not to draw a constant current via the bleeder but to modulate the current drawn by the bleeder. In the vicinity of the maximum LED current a higher bleed current will be drawn (lowering this LED maximum) and during the remaining time a lower bleed current will be drawn (not lowering the minimum too much or at all). In this way, at least a two step modulation function can be implemented with two different set values of the current to be drawn by the combination of the LED and the bleeder circuit. More specifically, when needing high bleeding during active powering, the resistance tuning circuit can set the bleed circuit to bleed a high amplitude current; otherwise to bleed a low amplitude current. The flicker can be further reduced.

In a more specific embodiment for implementing the resistance tuning circuit, the resistance tuning circuit may comprise the switching arrangement, wherein:

the switching arrangement is coupled to the current setting branch and is used to:

switch an parallel resistor into the current setting branch to decrease the emitter resistance of the current setting branch thereby achieving low bleed current when the rectified mains power is cut to zero;

switch the parallel resistor out of the current setting branch to increase the emitter resistance of the current setting branch thereby achieving high bleed current when the rectified mains power is uncut;

or the switching arrangement is coupled to the current bleed branch and is used to:

short circuit at least part of the emitter resistance of the current bleed branch thereby achieving high bleed current when the rectified mains power is uncut;

maintain the emitter resistance of the current bleed branch thereby achieving low bleed current when the rectified mains power is cut to zero.

In this way at least a two step modulation function can again be implemented with two different set values of the current to be drawn by bleeder circuit. By controlling the current setting portion or the current bleed portion, the size of the current which is provided to the LED is controlled.

In one embodiment, the circuit may comprise a peak detector coupled to the sense resistor arrangement for detecting the phase of the driving signal, wherein said peak detector is adapted to detect that the driving current is increasing, and enable the switching arrangement for shorting a resistor in an emitter path of the current setting branch thereby achieving high bleed current when the drive current is increasing;

and the bleeder circuit further comprises a time delay circuit which is adapted to act, after a certain time delay with respect to the detection of the driving current is increasing, to disable the switching arrangement from shorting the resistor.

This provides a circuit which can be implemented simply to provide shorting of a resistor to provide the desired at least two modulation levels of the bleed current portion.

In this embodiment, only one arrangement is used for detecting the increased driving current, namely the active powering phase, while a simple time delay circuit is used for reflecting the coming of the passive powering phase and there is no need for a specific detection circuit for the passive powering phase, in turn the cost is reduced.

In one embodiment, the circuit further comprises a smoothing capacitor for connection across the LED arrangement and providing a smoothed drive voltage to the LED arrangement, and the time delay circuit comprises a subcircuit with a capacitor (C6) coupled to a base of the switching arrangement.

This embodiment aims to solve the flicker problem resulting from the constant current function of the bleeder. In the absence of this subcircuit, the bleed current and LED current aim to maintain the same sum thereof. Thus the bleed current has a saddle shape (explained further below), and the LED current is more steep. The subcircuit is for disabling the switching arrangement from shorting the resistor ahead of the end of the second phase by a certain time duration. Due to the advanced end of the high level bleeding, the second peak in the saddle shape will be removed and in turn the LED current is more flat.

In one embodiment, the sense resistor arrangement may comprise first and second resistors in series, and a shorting arrangement may be provided for shorting one of the resistors in dependence on the driving current above a first threshold.

This arrangement enables an efficiency improvement by making the bleed current portion smaller if the conducting angle of the dimmed signal is larger (so that less bleed current is needed).

In one embodiment, the circuit may comprise a detector for detecting the driving signal, and for turning off the bleeder circuit when the driving signal exceeds a second threshold.

This circuit provides an activation function so that the bleed current is only activated when the LED drive voltage is below a threshold. In turn, when the LED is not dimmed, the bleeder circuit does not act thus ensuring a high lumen output of the LED and also saving energy.

In another embodiment, the driver circuit may further comprise:

a smoothing capacitor for connection across the LED arrangement;

an input receiving the driving current wherein in a second phase charging said smoothing capacitor, and in a first phase not charging said smoothing capacitor and allowing the smoothing capacitor to discharge; and a sensor for sensing the current flowing to the capacitor and for activating the bleeder circuit only when a charging capacitor current is flowing in the second phase.

This provides a more active way to control the bleeder circuit only to function during a charging current. Thus the energy charging the capacitor is reduced and the maximum LED current will be reduced whereas the discharging of the capacitor is not influenced, thus the ratio between max and min level of the LED current is small and flicker is reduced.

In a further embodiment, the bleeder circuit comprises a current sensing element in series with the smoothing capacitor for sensing a charging current of the smoothing capacitor; and the control circuit comprises a comparing circuit for enabling the bleeder circuit through a comparison between the sensed charging current of the smoothing capacitor with the sensed LED arrangement current.

This embodiment using one comparing circuit to control the bleeder circuit: in case the LED arrangement current is high the bleeder would not activated; in case the LED arrangement current is low but the capacitor is not being charged the bleeder would neither activated. The structure is with less components since only one comparing circuit is needed in processing the detections of LED arrangement current and capacitor charging current.

In still another embodiment, the driver circuit further comprises:

a smoothing capacitor for connection across the LED arrangement;

wherein the power source is adapted to provide the driving current in a second phase charging said smoothing capacitor and in a first phase not charging said smoothing capacitor and allowing the smoothing capacitor to discharge; and the driver circuit further comprises a switching arrangement in the form of a decoupling diode between the bleeder circuit and the smoothing capacitor to prevent the bleeder circuit from bleeding discharged current from the smoothing capacitor in the first phase, said decoupling diode being forwarded from the bleeder circuit to the smoothing capacitor.

This decoupling diode means that the bleeder circuit can only sink current in one direction, for example a charging current. In this way, the bleeder circuit is more active during the high voltage (uncut) phases of the rectified (and phase cut) input and is less active during the low voltage (cut) phases. The use of a diode provides a simple passive circuit.

As a result of the smoothing, the second phase of the input signal corresponds to capacitor charging and the first phase corresponds to capacitor discharging. The bleeder circuit is made operational only during the second phase to reduce ripple.

In a preferred embodiment, the bleeder circuit comprises a bleeding path coupled to the output of the power source via a diode, the circuit further comprising a capacitor in parallel with the bleeding path, the bleeding path is blocked from the smoothing capacitor via the decoupling diode, wherein the bleeder circuit further comprises a control path, and the smoothing capacitor is coupled to said control path.

In this embodiment, the smooth capacitor is blocked from the bleeding path is via the decoupling diode thus the smooth capacitor would not discharge through the bleeding path.

Alternatively, the bleeding path is in parallel with the smoothing capacitor and the LED arrangement, and the bleeder circuit further comprises a control path, and the output of the power source is coupled to said control path, and the control path is blocked from the smoothing capacitor via the decoupling diode.

In this embodiment, the control path activates the bleeding path only when control path is powered by the power source; when the power source does not provide driving current, the control path deactivates the bleeding path since the decoupling diode block the control path from the smoothing capacitor.

In a further embodiment, the control path is biased to be conducting, and the control circuit comprises a control switch coupled to the control path of the bleeder circuit, adapted: to turn on to shunt the control path so as to disable the bleeder circuit when the sensed LED arrangement current is less than the threshold; to turn off so as to enable the bleeder circuit when the sensed LED arrangement current is bigger than an upper limit.

This embodiment provides a specific circuit topology to implement the control circuit by using discrete components.

An aspect of the invention also provides a lighting circuit, comprising:

a driver circuit of above aspect and embodiments of the invention; and an LED arrangement driven by said driver circuit.

An aspect of the invention also provides a method of driving an LED arrangement, comprising:

receiving a driving signal comprising multiple phases each having either a first phase of passive powering and a second phase of active powering;

selectively removing a bleed portion from the driving signal, and supplying the remaining driving signal to the LED arrangement;

wherein the size of the bleed portion is dependent on the phase of the driving signal, and is on average higher during the second phase than during the first phase.

The size of the bleed portion may be set by switching in dependence on the timing of the input signal thereby to modulate the bleed portion.

These and other aspects of the invention will be apparent from and elucidated with reference to the embodiment(s) described hereinafter.

BRIEF DESCRIPTION OF THE DRAWINGS

Examples in accordance with aspects of the invention will now be described in detail with reference to the accompanying drawings, in which.

DETAILED DESCRIPTION OF THE EMBODIMENTS

The invention provides a driver circuit for driving an LED arrangement, comprising a power source for providing the LED arrangement with a regulated driving current, said converter being adapted to convert an dimmed input power into said driving current; a current sensing element in series with the LED arrangement and adapted to sense the LED arrangement current through the LED arrangement; a bleeder circuit having a bleeding path connected in parallel with the LED arrangement, adapted for removing a bleed portion from the driving current so as to decrease the output power of the LED arrangement; and a control circuit for enabling said bleeder circuit when the LED arrangement current sensed by the current sensing element is below a threshold so as to further dim the LED arrangement down.

Figure 1:
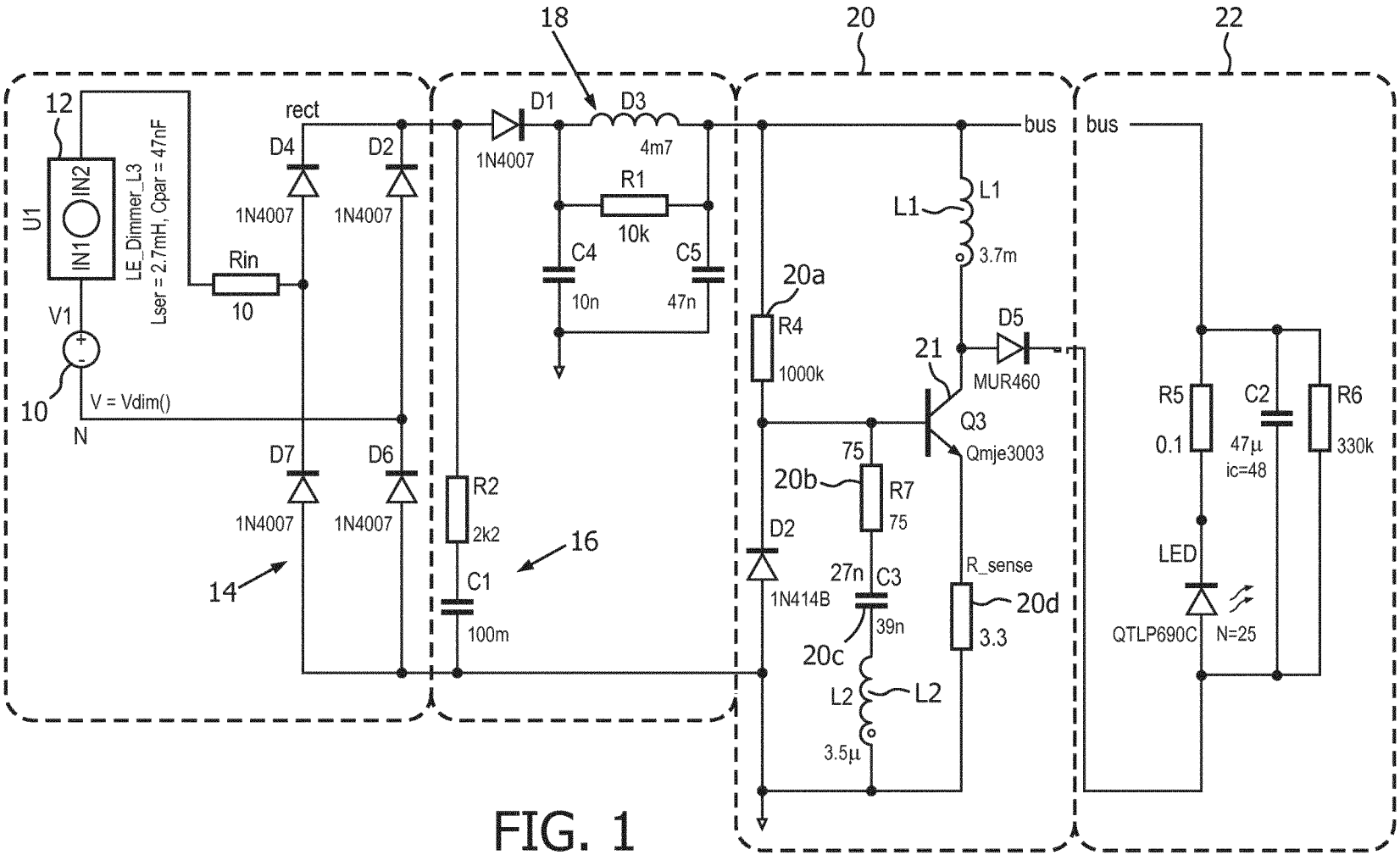
FIG. 1 shows a known LED driver circuit based on a Ringing Choke Converter ("RCC")

The invention will now be described as an extension to a known LED driver circuit (known as a "Ringing Choke Converter" or "RCC") as shown in FIG. 1, which is driving a LED light source.

Note that the same reference numbers are used in different circuits to denote the same components.

This circuit consist of the mains supply, realized e.g. as a 230 mains voltage system 10 with a leading edge dimmer 12. An ordinary diode bridge rectifier 14 is followed by an RC latch 16 to damp high frequency oscillations/ringing. An EMI filter stage 18 supplies the RCC converter 20 with its dc operating supply.

The self-resonating RCC converter works typically in a buck-boost mode making use of two coupled coils L1, L2 to generate a feedback signal controlling the current to be fed to the LED source 22. The inductor L1 acts as an energy store and delivers current to the LED source 22 when the main switching transistor 21 is off. The coupled inductor L2 influences the biasing of the transistor base to provide the desired self-resonance. In a more detailed principle, when transistor 21 is off, power will flow via resistors 20*a*,20*b* to charge capacitor 20*c*. When the capacitor 20*c* is charged to a certain level, the transistor turns on, and current will flow via inductor L1, transistor 21 and a sense resistor 20*d*. The inductive voltage on the inductor L2 due to coupling with the inductor L1 makes the capacitor 20*c* discharge and in turn the transistor 21 will be turned off again.

Figure 2:
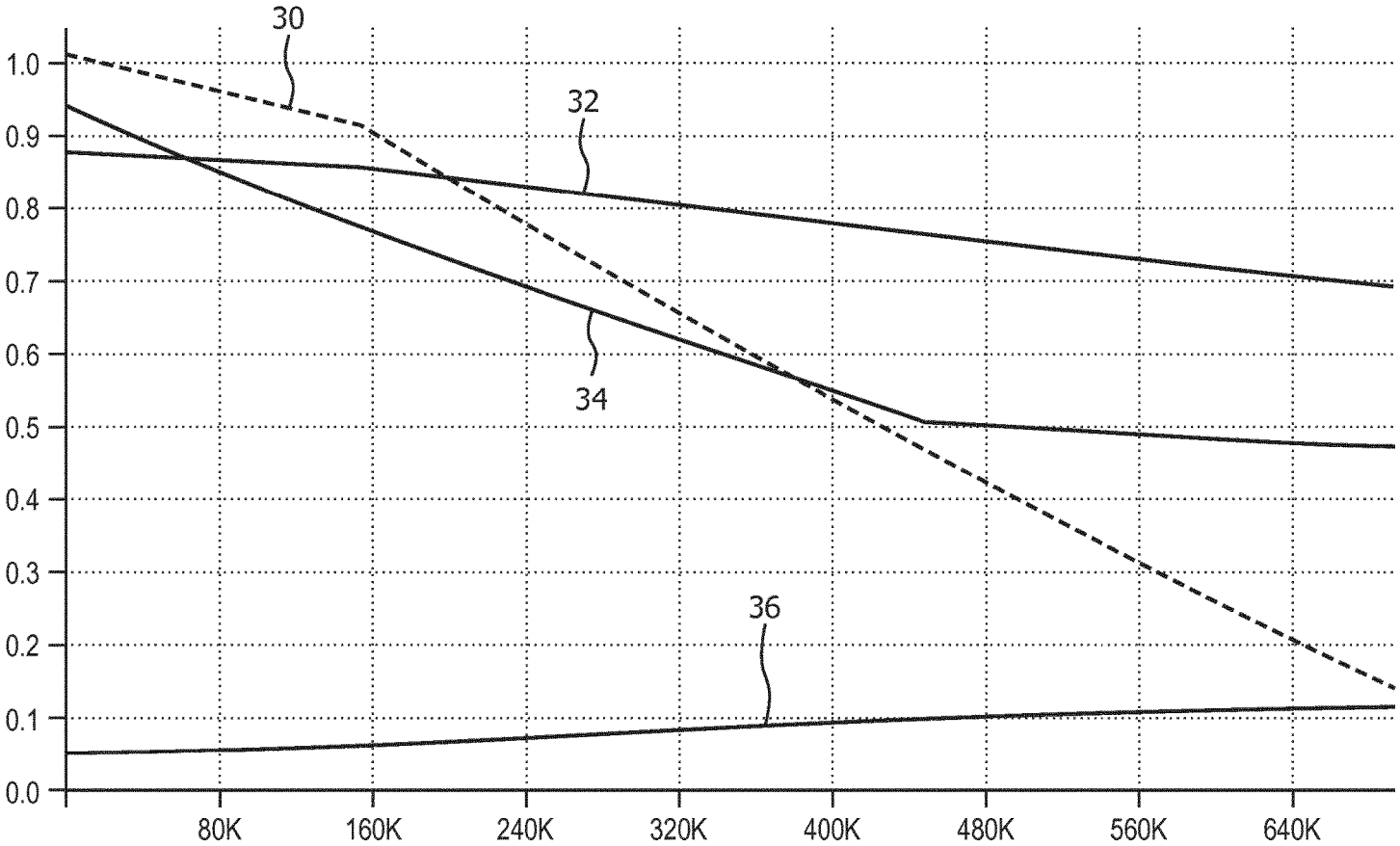
FIG. 2 presents the typical performance of the RCC converter in terms of LED current, efficiency, power factor and flicker response.

FIG. 2 presents the typical performance of the RCC converter, for example for a LED light source of about 10 W (the y-axis figure presents 1/10 of the real LED output power). On the x-axis the conducting angle in form of a resistor value is given. The relation between this resistor value and the real conducting angle is presented in the table below.

| $R_{dmin}$ (Ω) | 1 | 70k | 150k | 280k | 446k | 600k | 700k | 790k |
|---|---|---|---|---|---|---|---|---|
| Conduction Angle (α) | 180° | 150° | 135° | 120° | 900 | 60° | 45° | 30 |

Thus, the x axis represents the conducting angle from 180 degrees down to 45 degrees.

Plot 30 is the LED power, plot 32 is the efficiency, plot 36 is the power factor and plot 38 is the level of flickering. The flickering is calculated by considering the real current through the LED or LED string.

In the description below, the important relationship is the flickering curve 36 in relation to the actual output power of the LED source shown by curve 30. The aim of a deep dimming function is to reduce the LED output power as much as possible at the lowest conducting angle and with a flickering as low as possible. As can be seen in FIG. 2, the LED output power decreases whereas the flickering smoothly increases with a reduced conducting angle. At the lowest conducting angle of about 45° a minimum LED output power of 1.5 W (15%) is reached with a flickering of 12%.

A LED operated at a power of 1.5 W is still giving a high light intensity. By means of a bleeder circuit this output power of the LED can be further decreased but without an increase of the flickering.

Figure 3:
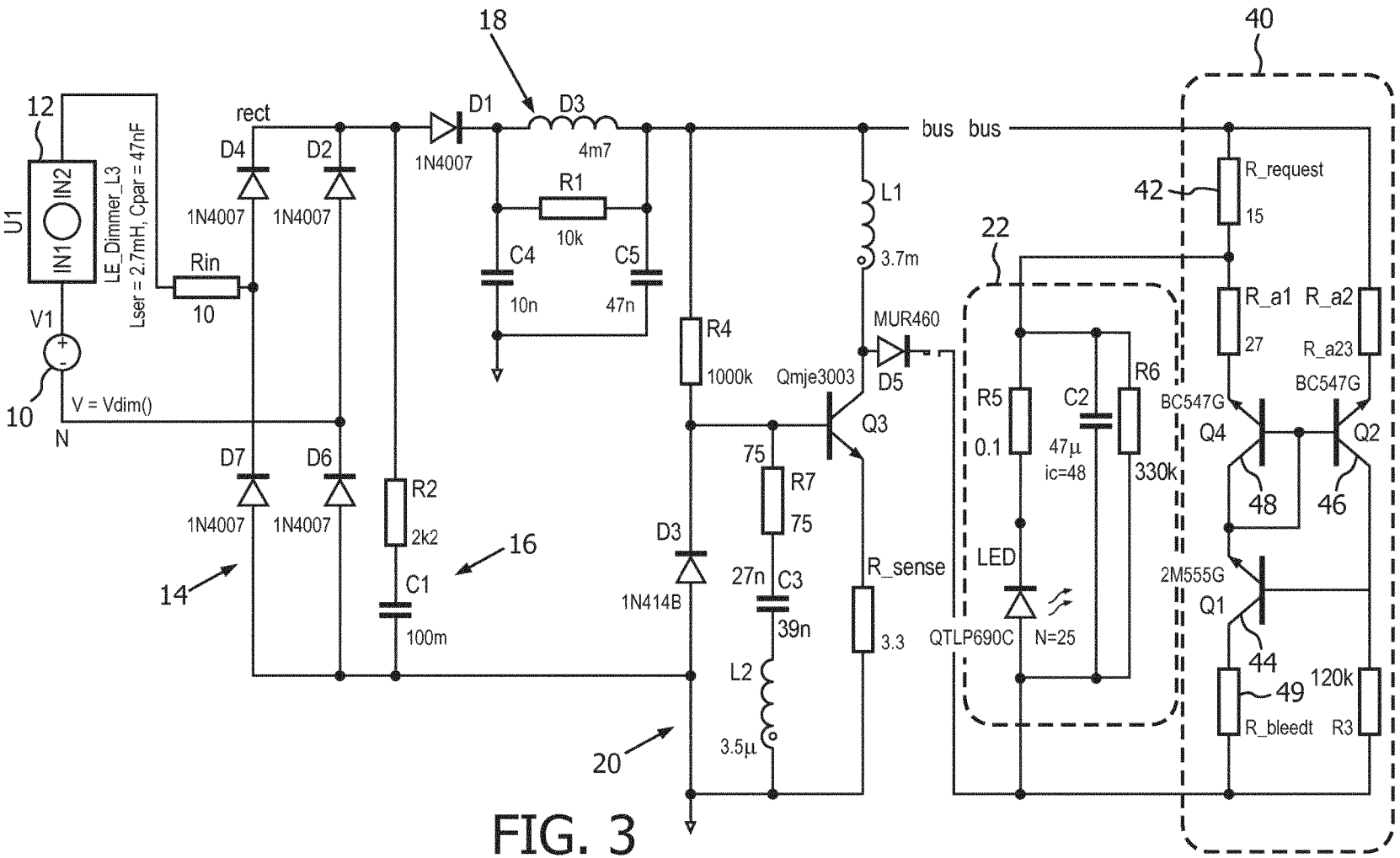
FIG. 3 shows a bleeder circuit proposed by the applicant (but not yet published at the filing of this application)

FIG. 3 shows a bleeder circuit proposed by the applicant (but not yet published at the filing of this application). There are different possibilities to expend surplus energy delivered by the converter by means of resistive and/or semiconductor based loads.

The solution shown in FIG. 3 is based on a parallel constant current drain, self-activated if the LED current is below a certain value. The bleeder circuit is shown as 40. It comprises a sense resistor 42 through which the LED current passes.

There are two branches which deliver current to the sense resistor 42. One is a current setting branch including transistor 46 and the other is a current bleed branch controlled by transistor 44. It can be understood that the structure of the two branches resembles a current mirror wherein the currents through two branches keeps a certain relationship.

The circuit includes feedback to maintain a constant current through the sense resistor 42 once the bleeder circuit is activated.

As soon as the current through the LED (and accordingly through the sense resistor 42) drops below a certain value, the emitter potential of transistor 48 drops, transistor 48 starts to turn on and the bleeder function is activated. The actual activation point can be predefined (in a limited range) by means of selecting the resistance value of the corresponding sense resistor 42. Further, the lower the LED current gets, the higher the parallel bleed current through transistor 44 since the emitter potential of transistor 48 is lower. Transistor 44 and resistor 42 function as dissipative elements, for absorbing the surplus energy delivered by the RCC converter. The exemplarily bleeder works as a constant current drain, i.e. the sum of LED current and bleed current stays constant, controlled by a transistor 46. In particular, transistor 46 and 48 function as a current mirror and compensate for temperature variations. The bleed current is related to the value of the bleeding resistor 49 as well as the emitter resistances of the current mirror pair 46,48.

In order to adjust the bleed current the bleeding resistor value 49 can be tuned. A further important parameter to tune the bleed current (and the whole functionality) is the relation of the two emitter resistances $g=R_{e48}/R_{e46}$. The higher the gain 'g' is the higher the bleed current is. In FIG. 3, $R_{e48}$ is shown as a separate resistor connected to the emitter and $R_{e46}$ is also shown as a separate resistor connected to the emitter.

Figure 4:
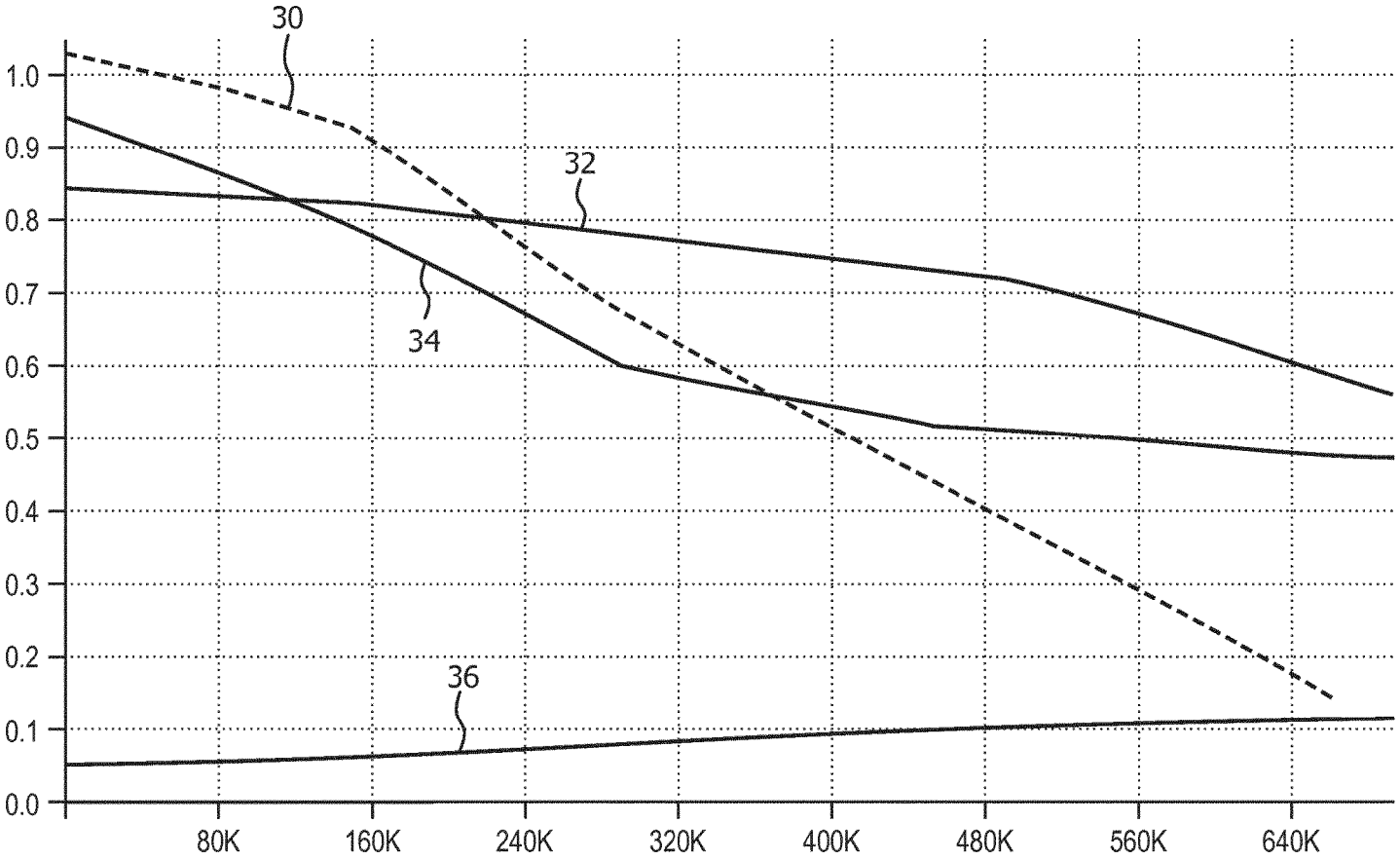
FIG. 4 shows graphically the functioning of the converter of FIG. 3 again in terms of LED current, efficiency, power factor and flicker response.

FIG. 4 shows the performance of the converter of FIG. 3. The plots are the same as in FIG. 2, so that plot 30 is the LED power, plot 32 is the efficiency, plot 36 is the power factor and plot 38 is the level of flickering.

By comparing this result with the data presented in FIG. 2 (RCC without bleeder) a clear improvement can be observed. The low end level (LEL) can be reduced to 11% (instead of 15%). The flickering increases slightly to about 13.5% (instead of 12%).

There is still however an issue that for very low emission levels, e.g. only 5% so approximately 0.5 W, the flickering increases to more than 20%. This is too high because of unpleasant reactions from consumers.

The various examples in accordance with the invention allow the 'Low End Level' (LEL) light output of LED based lamps to be reduced much more than according to state of the art technologies (as shown above). At the same time, the flickering can be further reduced in contrast to known bleeders where the flickering typically gets worse.

The problem with the constant current approach can be made clear by analyzing the signals in more detail.

Figure 5:
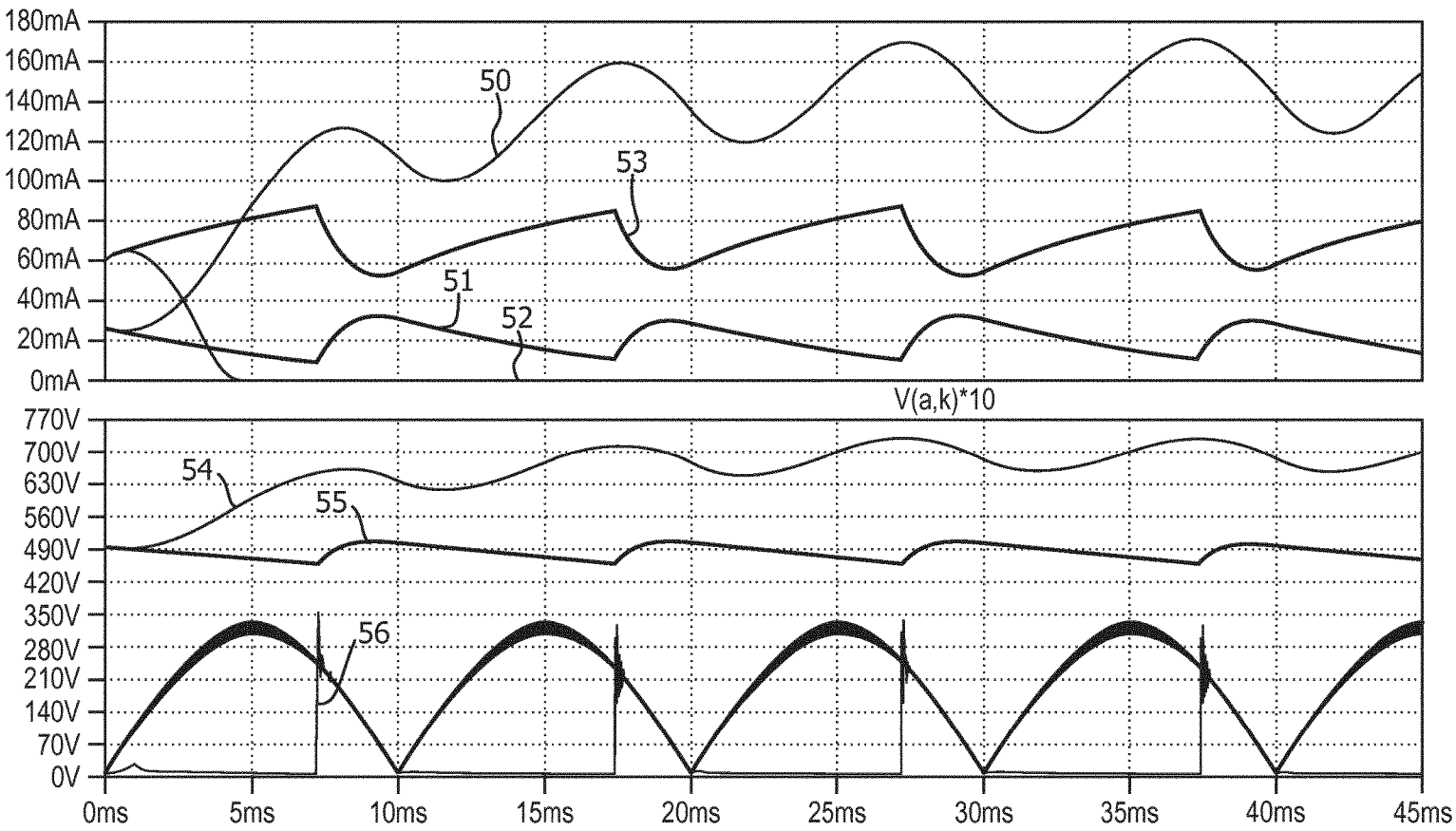
FIG. 5 provides further analysis of the functioning of the converter of FIG. 3.

FIG. 5 shows as plot 50 the LED current for a phase cut of 180° (full conducting angle) and as plot 51 the LED current for a phase cut of 45°. The bleed current for a phase cut of 180° is shown as plot 52 and the bleed current for a phase cut of 45° is shown as plot 53. The sensing voltage is shown as plot 54 for a phase cut of 180° and the sensing voltage is shown as 55 for a phase cut of 45°.

The phase cut signal is shown as 56.

If the conducting angle is below 45°, it clearly can be observed that the bleed current 53 behaves differently to the LED current 51. If the LED current increases, the bleed current decreases (and vice versa). Due to the constant current approach, the bleeder is designed to guarantee a constant current resulting from the sum of the LED current and the bleed current. However, in terms of reducing the flickering this behavior is not suited very well.

Some embodiments below realize a bleed current waveform which reduces the flickering of a LED light source. This can be realized by implementing a modulated bleed current. In order to smooth the LED current, the bleed current needs to be high in the vicinity of the maximum of the LED current and needs to be low(er) at the remaining time. This results in a reduced maximum LED current (since in parallel current is drawn through the bleeder). In addition, since a lower current is drawn by the bleeder during the remaining time, a smoothed discharge current from the smoothing capacitor of the LED source circuit results, lifting the minimum LED current. As result, the difference between maximum LED current and minimum LED currents is smaller, thus the flickering is lower.

Figure 6:
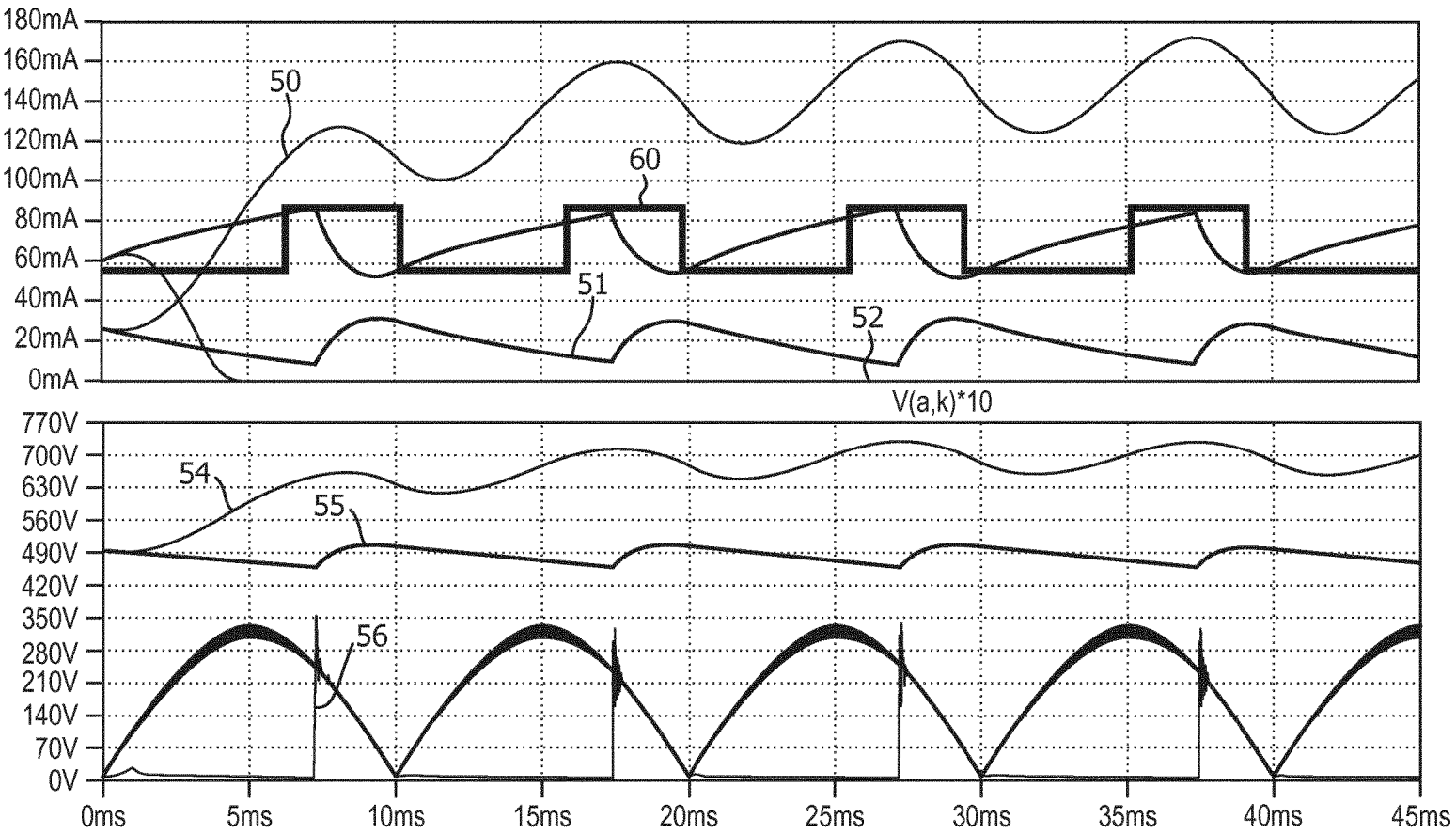
FIG. 6 shows schematically an example of the basic approach adopted in accordance with the invention as a modification to the waveforms of FIG. 5.

FIG. 6 shows a first example of the basic approach in which a desired bleed current waveform 60 is superposed over the waveforms of FIG. 5.

The bleed current has a high level and a low level, and adopts a square wave profile based on these two levels.

Depending on the amplitude of the high level bleed current and on the low level bleed current, as well as on the duration of each of the two sub-cycles the current through the LED can be influenced in a wide range so that the flickering can be reduced very well.

If the low level bleeding amplitude is zero, an ordinary rectangular pulse shaped voltage waveform without any dc offset may be used. This allows for further performance improvements and reduced cost, since even less components are required to realize the required circuitry.

Figure 7:
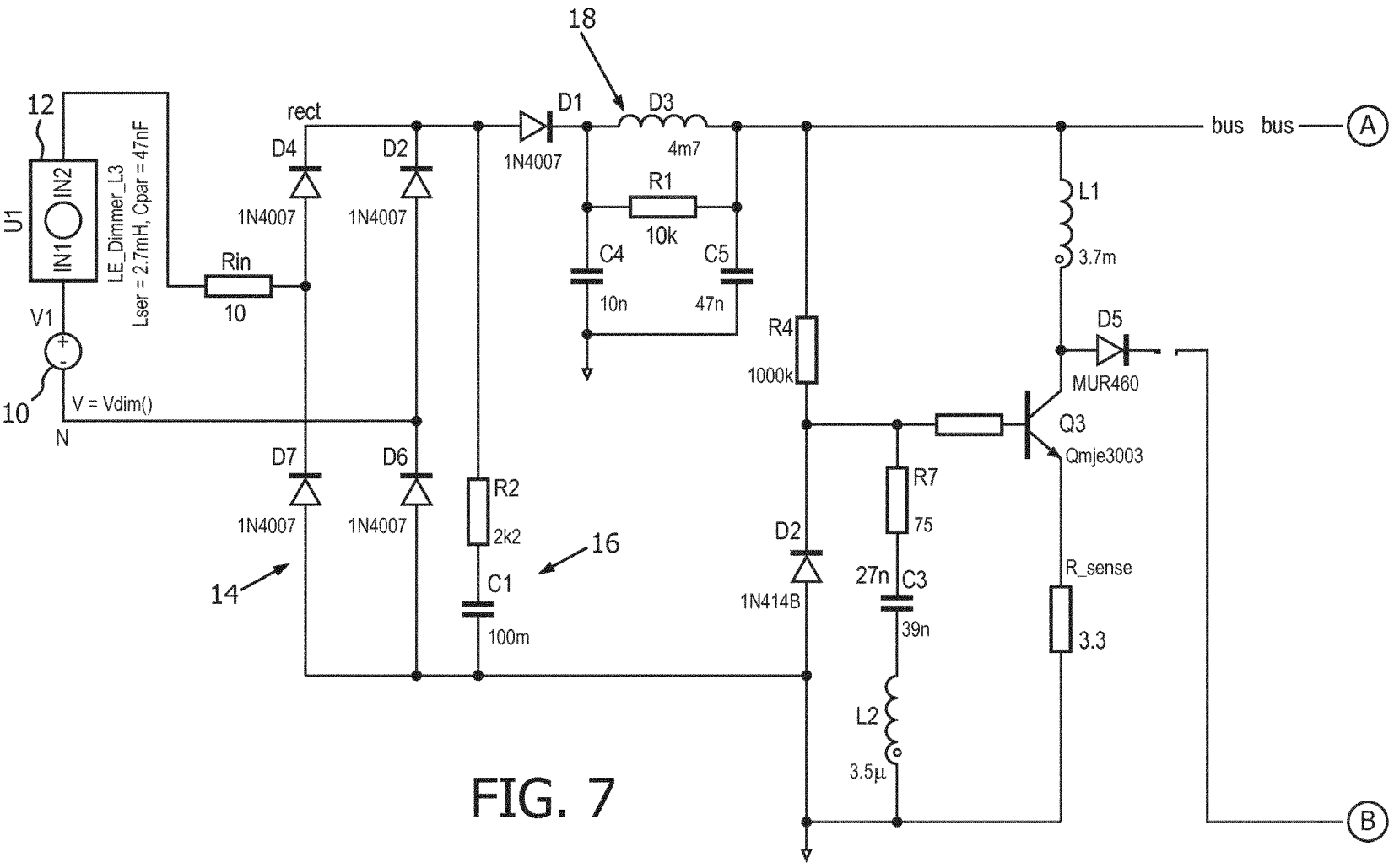
FIG. 7 shows a first example of converter circuit.
Figure 7:
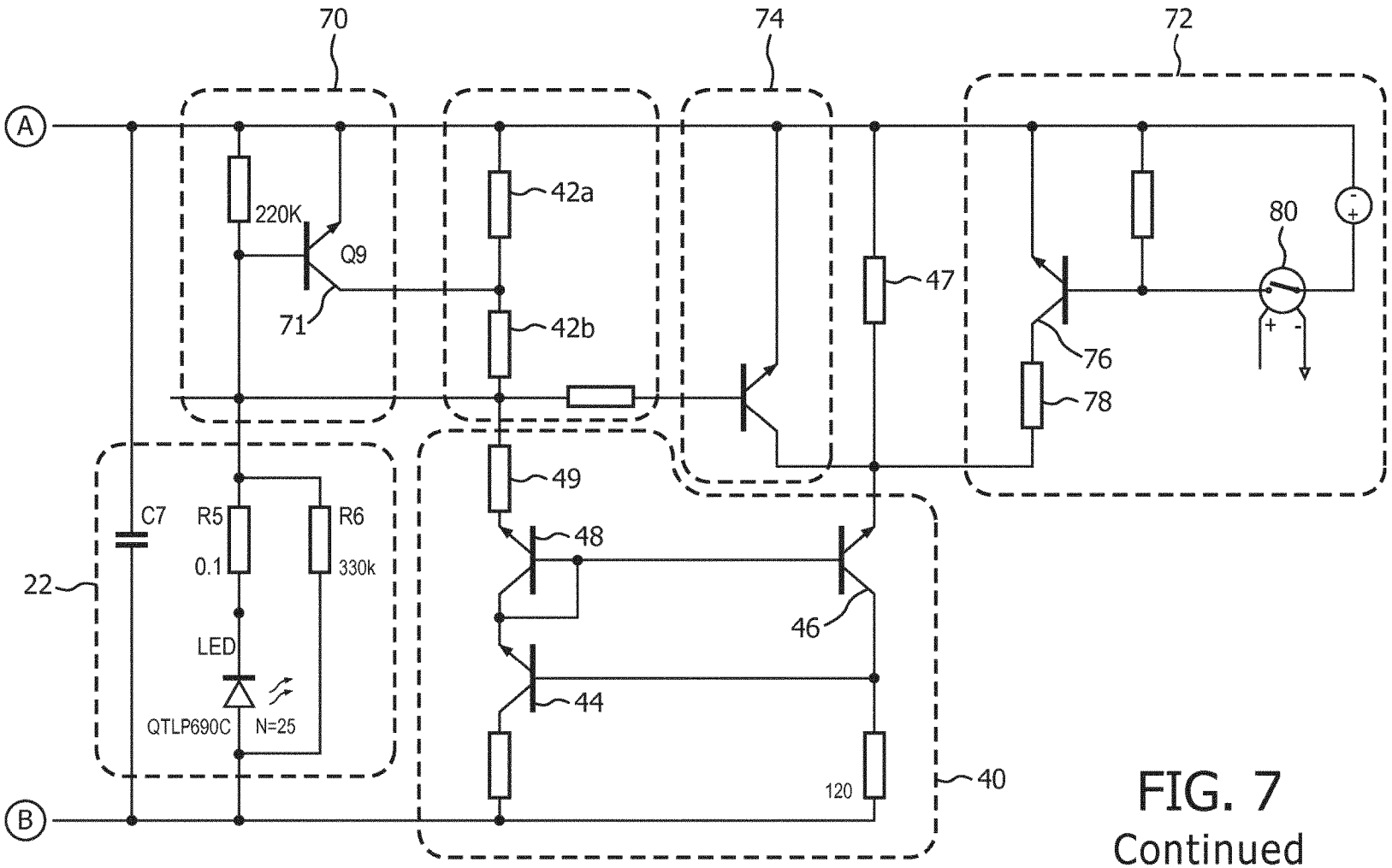

A first approach realizing the 2 step modulated bleeder function is shown in FIG. 7.

The circuit comprises a modification to the circuit of FIG. 3 by adding a two step modulation function, using circuit blocks 70,72,74.

In order to improve the efficiency and to switch off the bleeder in a non dim state (180° conducting angle) two switching functions are added to the constant current bleeder approach.

One switching function implemented by blocks 70 and 72 reduces the losses in the sense resistor 42 which senses the current through the LED and the bleeder, by splitting this resistance into two separate resistors 42*a* and 42*b*. Thus, the sense resistor arrangement comprises first and second resistors in series, and a shorting arrangement is provided for shorting one of the resistors in dependence on the driving signal above a first threshold. The resistor 42*a* can be shorted by a transistor 71 if the current is high enough, e.g. at very large conducting angles.

Another transistor switch 74 is used to deactivate the whole bleeder function and thus improves the efficiency at large conducting angles as well. This transistor 74 shorts the emitter resistor of the control transistor 46 of the bleeder circuit 40 and thus pulls down the base of the main bleeding transistor 44.

The switching functions mentioned above can easily be realized by using other switching devices such as e.g. PNP transistors or MOSFET transistors, instead of the NPN bipolar transistors shown.

The two step modulated bleeder function is also realized by means of a switch 76 in the circuit block 72. The gain defined as $g=R_{e48}/R_{e46}$ defines the current through the bleeder circuit and the whole functionality. In FIG. 7, the resistor 49 is $R_{e48}$ and the resistor 47 is $R_{e46}$. The higher the gain 'g' is the higher the bleed current is. The emitter resistance can be modulated by means of the switching transistor 76 and accordingly modify or modulate the gain. At least two stages are required (high level and low level), but even more stages/levels might be implemented as well.

The gain itself is modulated by adding a parallel resistor 78 to the emitter sense resistor 47 of the transistor 46 and activating this additional resistor by means of a controlled switch, namely the transistor 76. If this switch is closed, the emitter sense resistor is defined by the parallel circuit of 47 and 78, and accordingly the gain will be reduced, resulting in a lower bleed current (low level bleeding). If the switch is open, the additional sense resistor 78 is decoupled and hence the gain will increase (defined only by the sense resistor 47 in relation to resistor 49). In this state the bleed current reaches its nominal value (high level bleeding).

The control of the switching transistor 76 is shown implemented in ideal manner simply as a function of time. For this purpose, a further (ideal) switch 80 is represented to feed the base of transistor 76 by a low dc voltage when activating the low level bleed current. When deactivating the low level bleeding (i.e. high level bleeding is required) the switch 80 is open and the base of transistor 76 is pulled down via the pull down parallel resistor 78.

For the control of the switch as a function of time, if the phase cut dimmer produces the rising edge (of the mains voltage), the active powering begins and the switch 80 is deactivated (high level bleeding is activated). About one millisecond after the mains voltage reaches zero, the passive powering begins and the switch 80 is activated (low level bleeding is activated). The circuitry might be realized by means of other timing and/or triggering approaches as well.

In the circuit of FIG. 7, the bleeder circuit comprises a first branch which comprises a current bleed branch 48, 44 in parallel with the LED arrangement 22 and a sense resistor arrangement 42*a*, 42*b* having an output which connects to the LED arrangement and to the current bleed branch. A current setting branch 46 is for setting the bleed portion of the driving signal that is bled by the current bleed branch. Transistors in the current bleed branch and the current setting branch form a current mirror as explained above.

It can be seen that the bleeder circuit additionally comprises a switching arrangement which is adapted to switch in dependence on the phase of the rectified mains power, thereby to modulate the current in the bleed path.

The bleed portion of the driving signal is dependent on the ratio between the emitter resistance 47 of the current setting branch and the emitter resistance of the current bleed branch 49 of the current mirror circuit.

The circuit 72 functions as a resistance tuning circuit which in this example is coupled to the current setting branch and adjusts the emitter resistance of the current setting branch.

In the example of FIG. 7, the circuit 72 comprises a switching arrangement coupled to the current setting branch and it is used to:

(i) switch an additional parallel resistor into the current setting branch to decrease the emitter resistance of the current setting branch thereby achieving low bleed when the first phase of the driving signal occurs or the rectified mains power is cut to zero, or (ii) switch the additional parallel resistor out of the current setting branch to increase the emitter resistance of the current setting branch thereby achieving high bleed when the second phase of the driving signal occurs or the rectified mains power is uncut.

Figure 8:
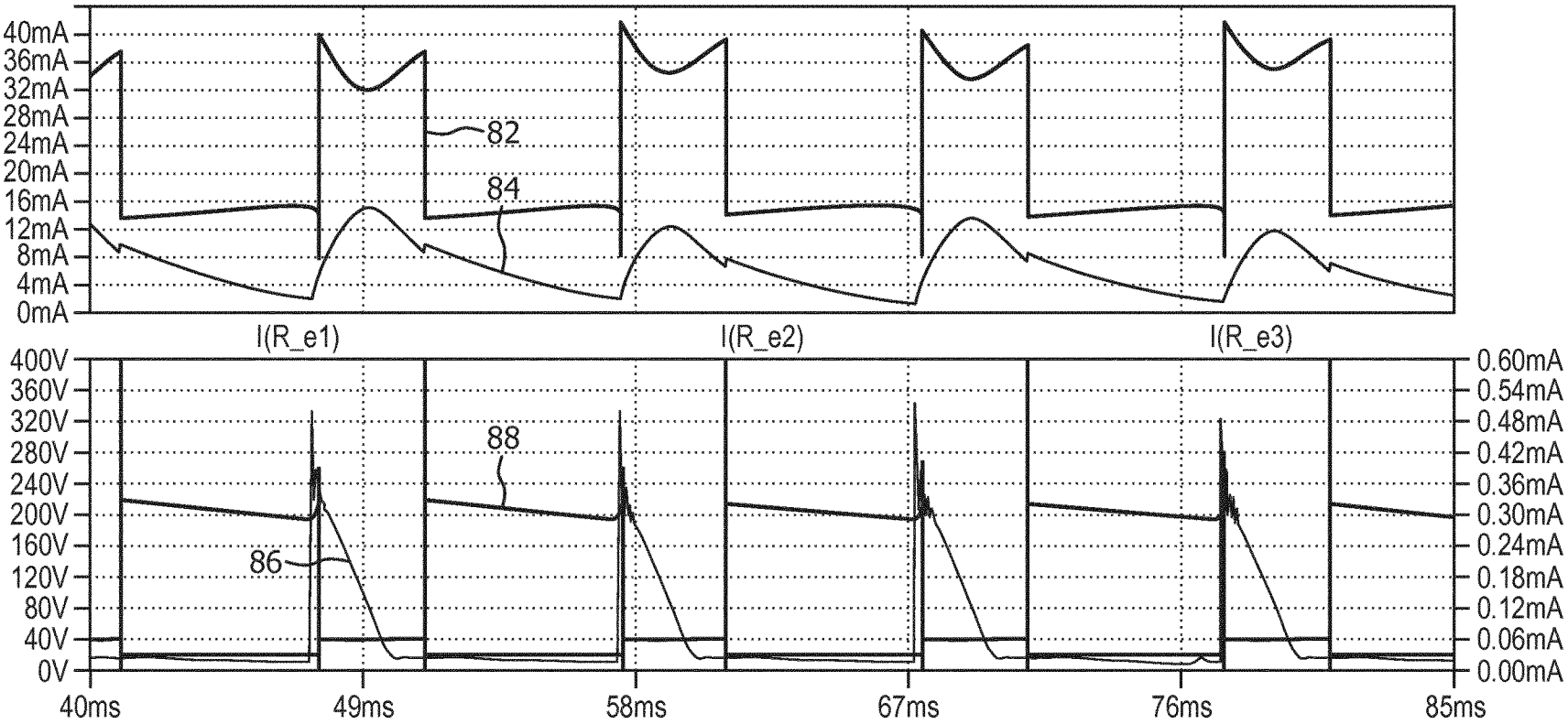
FIG. 8 shows the performance of the circuit of FIG. 7 for a conducting angle of 45°.

FIG. 8 shows the performance of the circuit of FIG. 7 for a conducting angle of 45°. The bleed current is shown as 82 and the LED current is shown as 84. The rectified phase cut mains voltage is shown as 86 and the switching signal controlled the bleed function is shown as 88. The two step modulated switching behavior of the bleed current can be observed between a high level bleeding of around 35 mA and a low level bleeding of around 15 mA. In the vicinity of the maximum of the bleed current the constant current function of the standard bleeder is working, responsible for generating the small drop shown.

Figure 9:
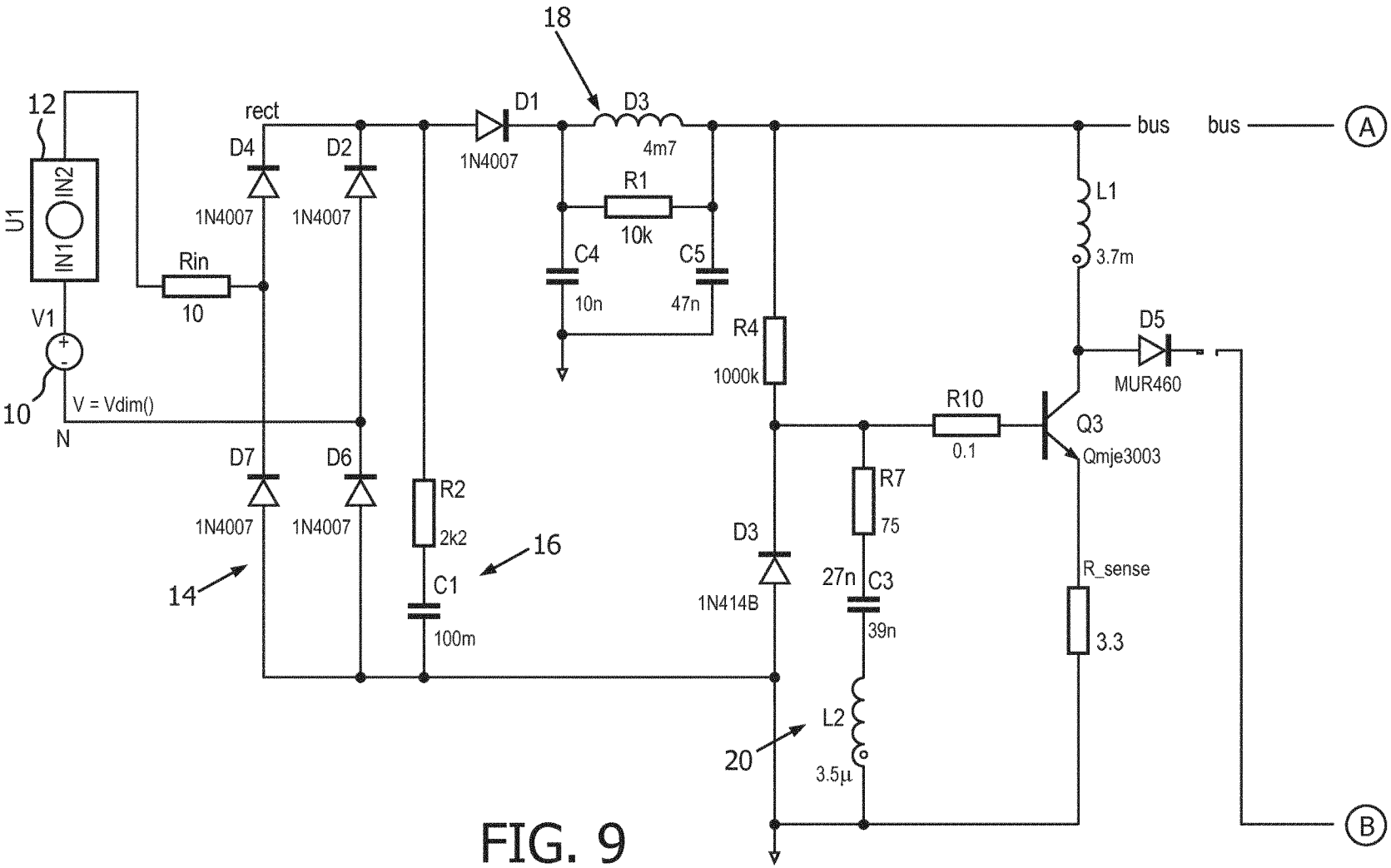
FIG. 9 shows a second example of converter circuit.
Figure 9:
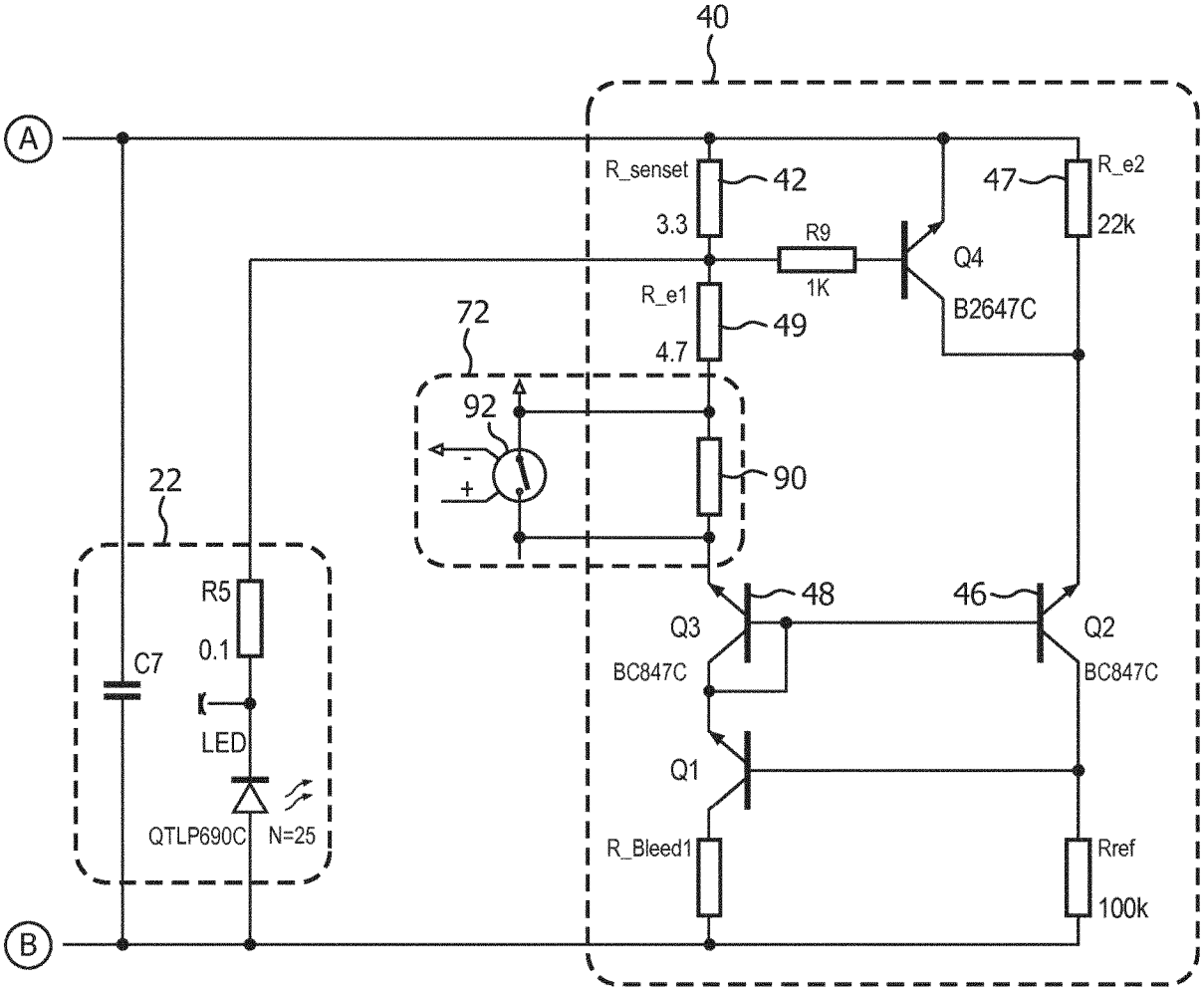

Another approach to realize the modulated bleeder function is to modify the second emitter sense resistor 49. Since this resistance forms the denominator of the bleeder gain function, the function of a short circuiting switch needs to be opposite compared to the use of the second emitter resistor 47. However, the basic approach is the same as shown in FIG. 9.

In order to reduce the gain an additional resistor 90 is connected in series with the emitter sense resistor 49. If this resistor 90 is high enough the gain is reduced to very small numbers (to almost zero). If the additional resistor 90 can be shorted by a switch 92 the same gain modulation (high level bleeding, low level bleeding) can be realized.

To short the added series resistor 90 the switch 92 is controlled. If the switch is closed (the additional resistor is shorted) the nominal bleed current will be drawn (high level bleeding), if the switch is open the emitter resistance of transistor 48 is higher, hence reducing the bleed current (low level bleeding).

Figure 10:
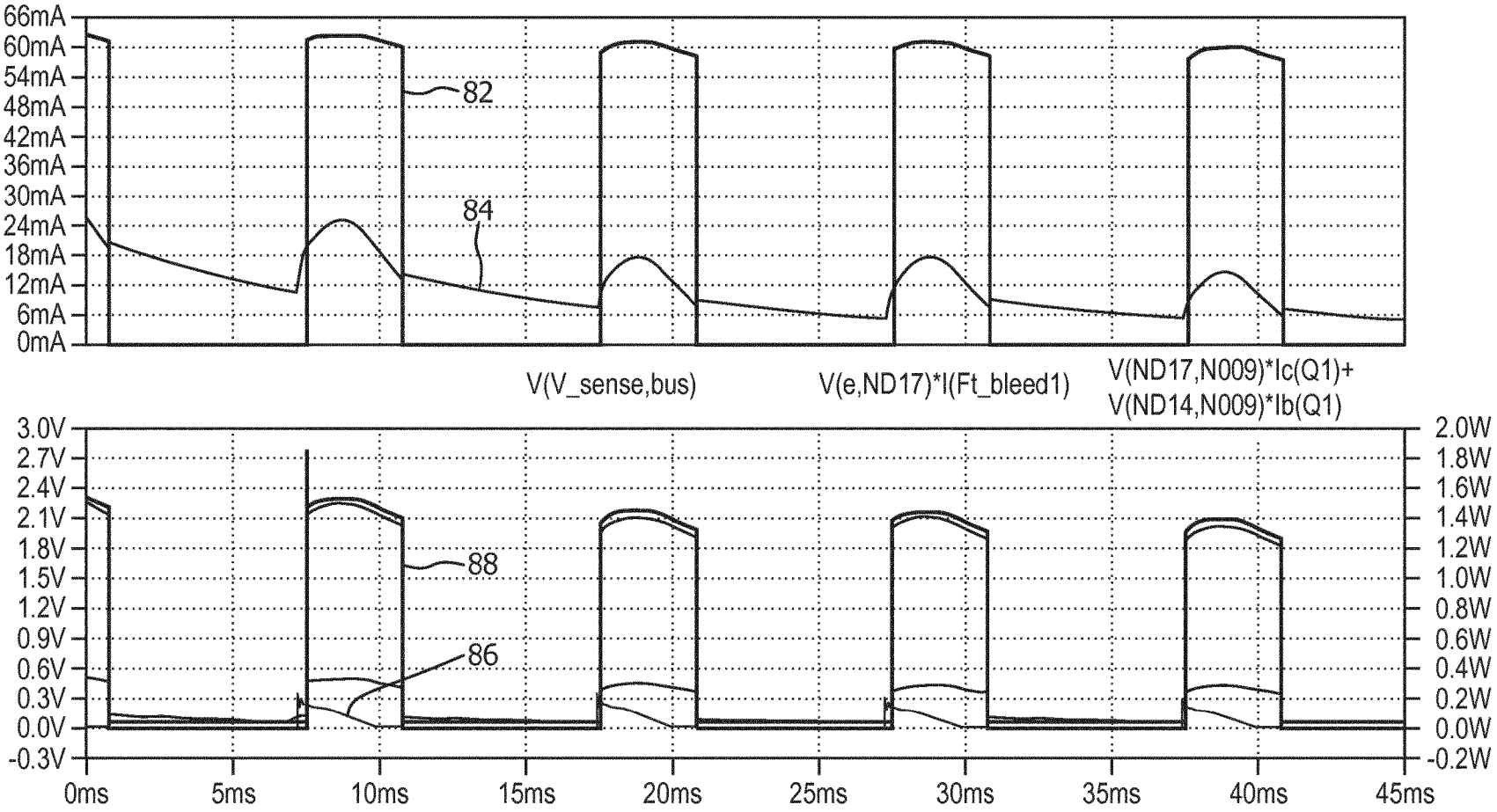
FIG. 10 shows the performance of the circuit of FIG. 9 for a conducting angle of 45°.

The corresponding performance is shown in FIG. 10, using the same references as in FIG. 9 again for a conducting angle of 45°. The bleed current 82 can be switched between 60 mA and zero, having a big impact on the current shape of the LED. In this example, the switching arrangement of the circuit 72 is coupled to the current bleed branch and is used to:

(i) short circuit at least part of the emitter resistance 49 of the current bleed branch thereby achieving high bleed when the second phase of the driving signal occurs or the rectified mains power is uncut; or (ii) maintain the emitter resistance 49 of the current bleed branch thereby achieving low bleed when the first phase of the driving signal occurs or the rectified mains power is cut to zero.

Figure 11:
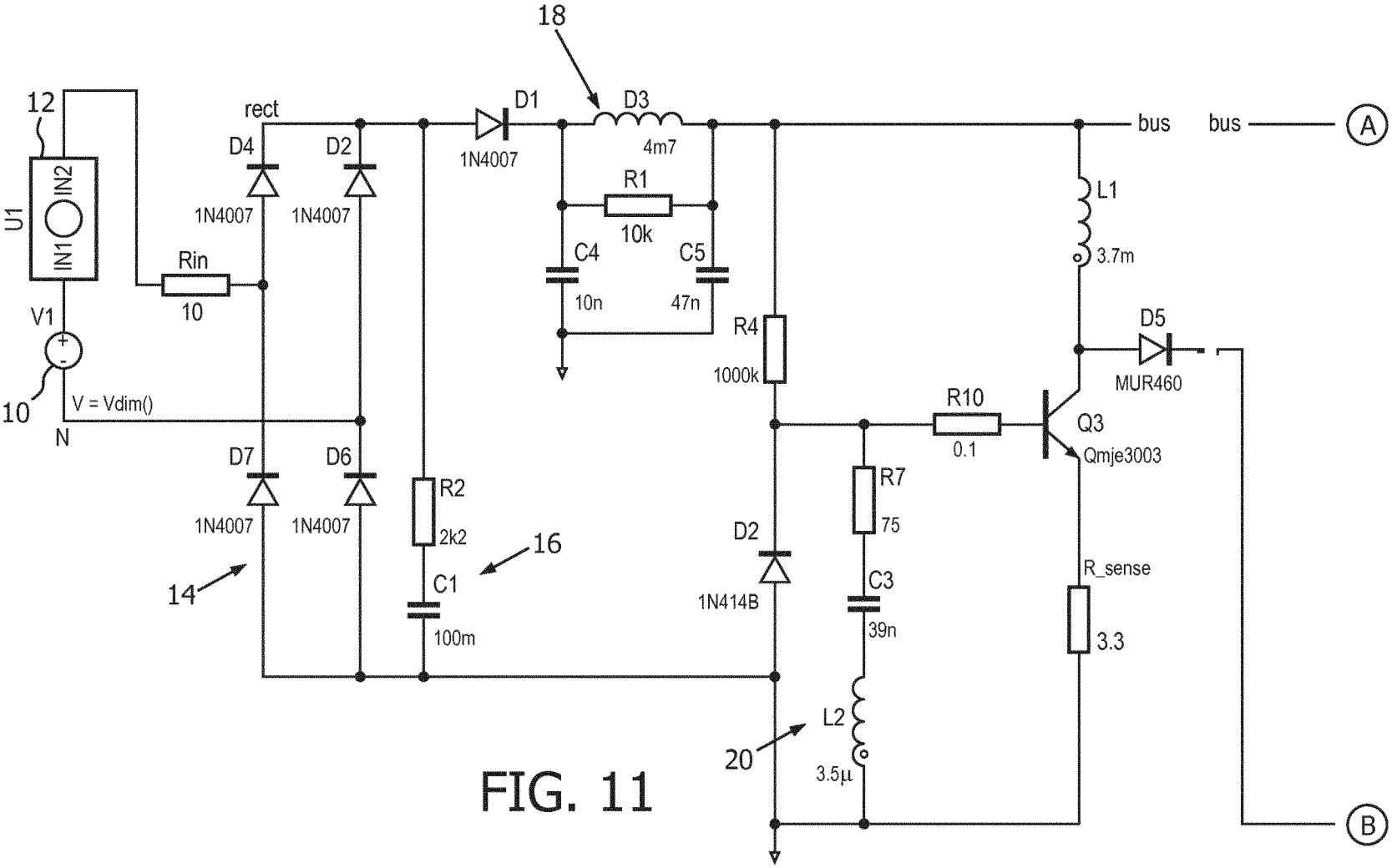
FIG. 11 shows an implementation of the circuit shown only conceptually in FIG. 9.
Figure 11:
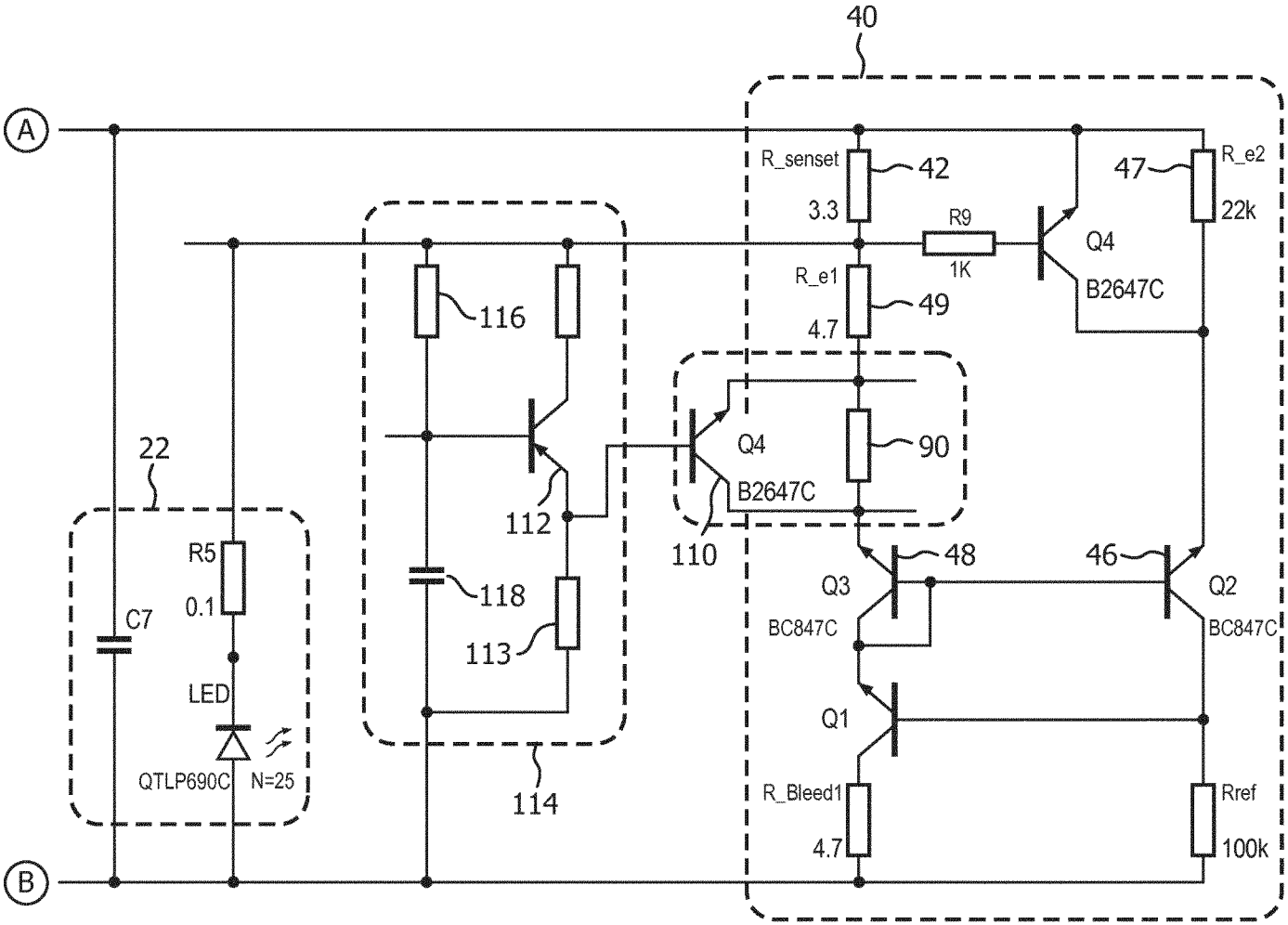

FIG. 11 shows a realization of the switch of the circuit block 72 for the circuit of FIG. 9. In particular, it proposes a realization of the switch 92 which is conducting or non-conducting according to the phase of the driving signal. The switch 92 is realized by an ordinary bipolar transistor 110 together with other component to sense the phase of the driving signal, although any other switching components might be used as well. In detail, to control this switch 110 an RC peak detector 116,118 is used, followed by a transistor 112 and associated resistor 113 at its emitter, and thus forming a base resistor of the transistor 110. These elements define the state of the switching transistor responsible for the bleeding status (high/low level bleeding). These units together form circuit block 114.

Each time the LED current makes a positive step a higher peak voltage is generated across resistor 116 of the peak detector. If this voltage is high enough, the control transistor 112 becomes non-conducting, activating the switching transistor 110, short circuiting the additional high ohmic emitter resistor 90 and accordingly activating the high level bleeding state. During a certain time, depending on the time constant defined by resistor 116 and capacitor 118 of the peak detector, the voltage across the capacitor increases, reducing the voltage across the resistor, forcing the control transistor 112 to start conducting. This opens the transistor 110, and thus activates resistor 90 and accordingly enters the low level bleeding mode.

This arrangement thus uses a peak detector coupled to the sense resistor arrangement for detecting the phase of the driving signal, and a resistor is shorted in the emitter path of the current setting branch. A time delay circuit, implemented by block 114, is adapted to act, after a certain time delay with respect to the detection of said increased driving current, to disable the switching arrangement from shorting the resistor.

Figure 12:
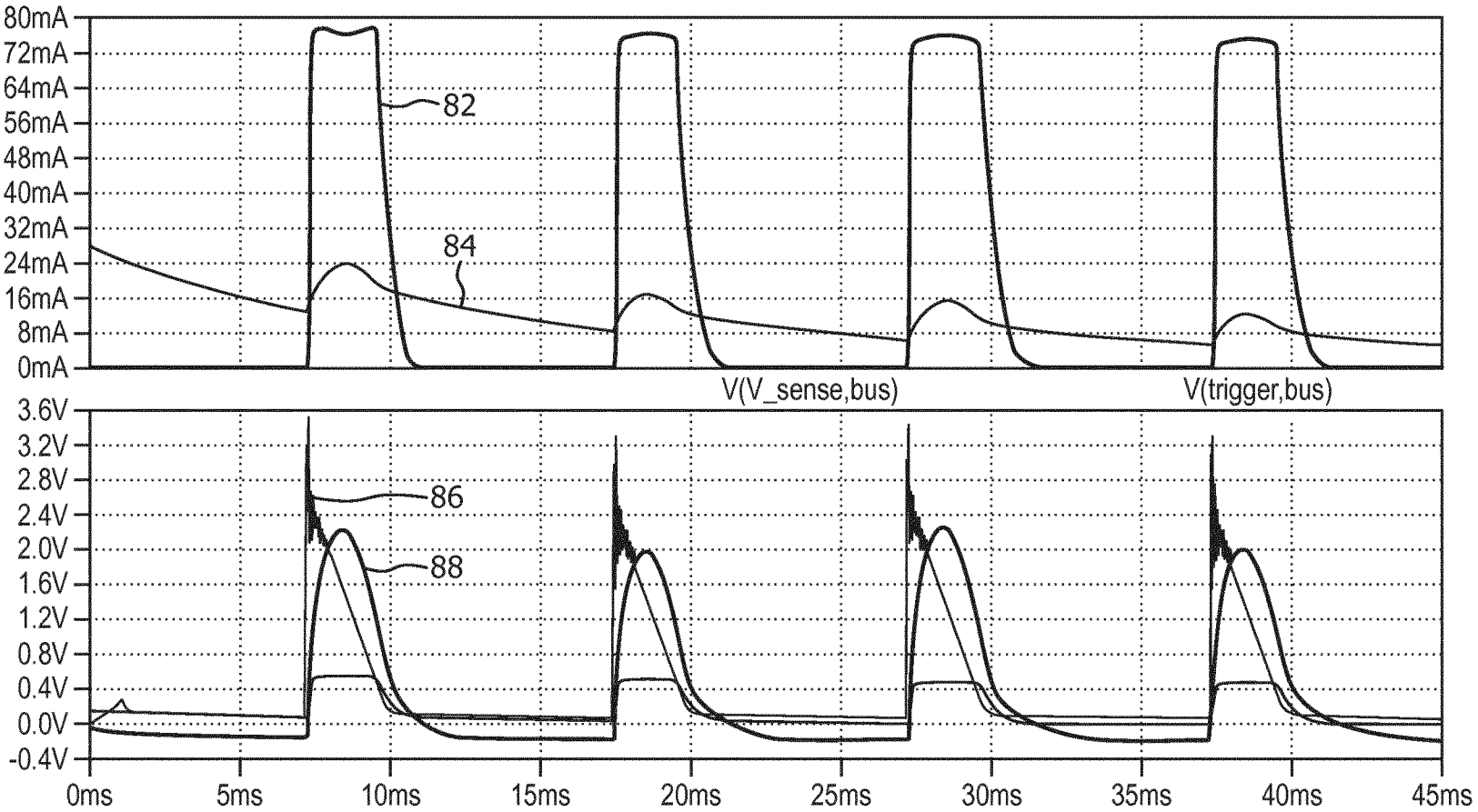
FIG. 12 shows a simulation of the operation of the circuit of FIG. 11.

The simulation result of this circuit is shown in FIG. 12 for a conducting angle of 45° and using the same references as in FIG. 10. The bleed current can be switched between 75 mA and zero, having a big impact on the current shape of the LED.

Figure 13:
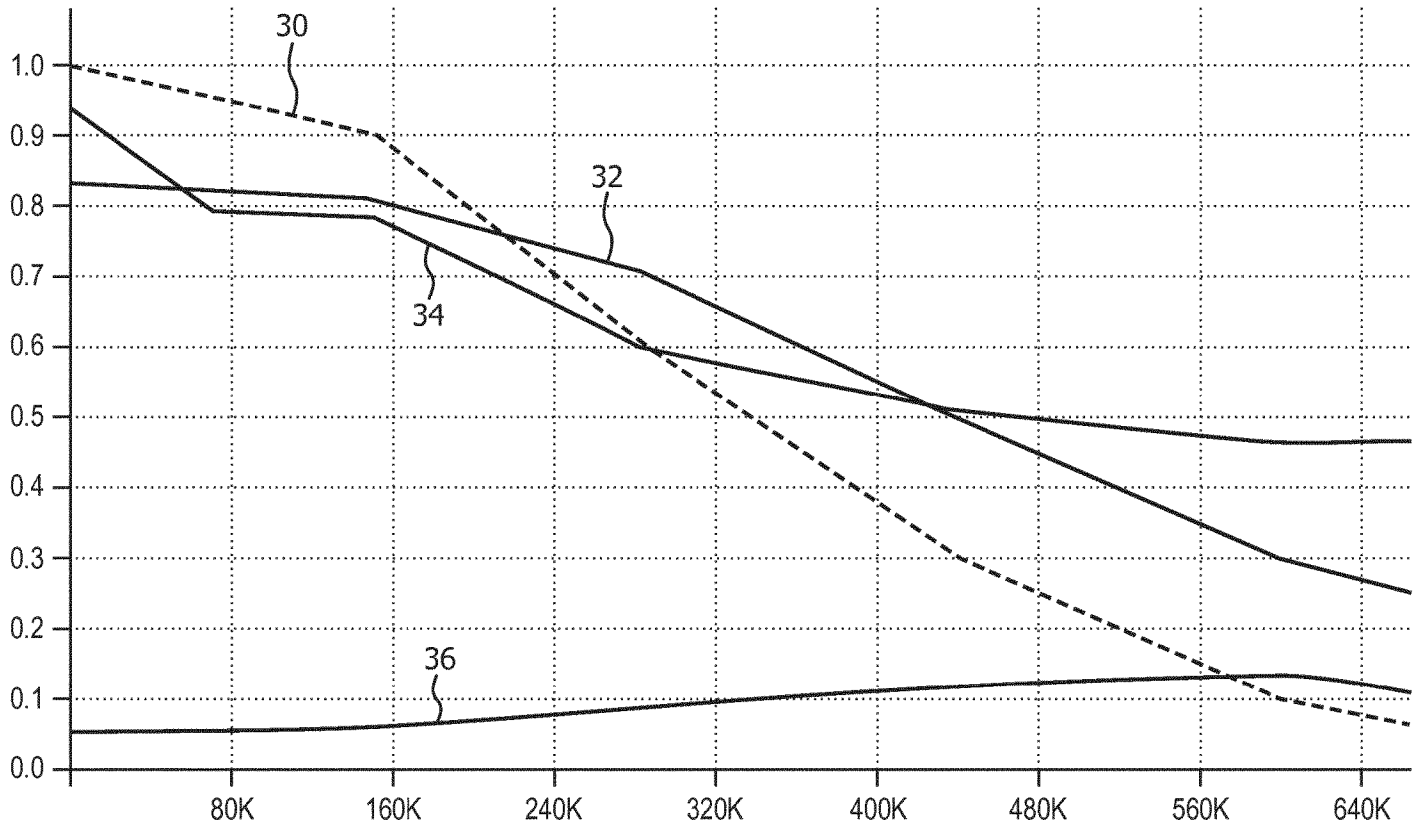
FIG. 13 shows the performance of the circuit in terms of LED current, efficiency, power factor and flicker response for the circuit of FIG. 11.

FIG. 13 shows the typical performance data for the circuit of FIG. 11.

As in FIG. 2, plot 30 is the LED power, plot 32 is the efficiency, plot 36 is the power factor and plot 38 is the level of flickering.

The whole circuitry can for example be tuned to achieve a LEL of only 4% at the lowest conducting angle of 45°. An improvement for the flickering down to only 10% at the LEL can be observed. If these numbers are compared to the earlier result of FIG. 4 (11% LED power, 13.5% flickering) a large improvement can be appreciated.

In this example, the flickering still shows a local maximum of about 15% at a conducting angle of approximately 60°. A way to improve (thus reducing the local maximum) is described further below.

Figure 14:
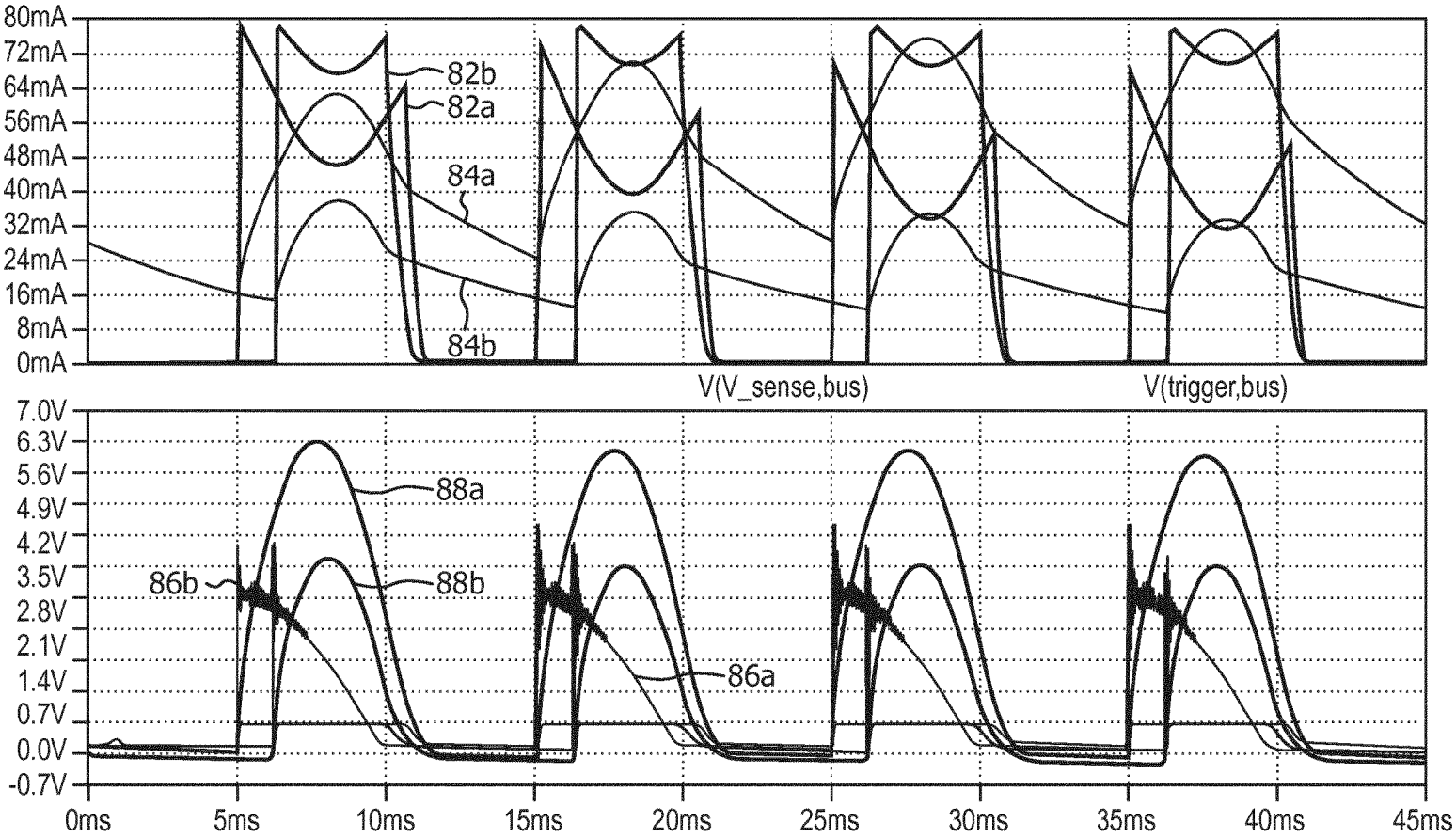
FIG. 14 provides further analysis of the functioning of the converter of FIG. 11 for two different phase angles.

The basic root cause for the local maximum during the variation of the conducting angle is based on the fact that the constant current function of the bleeder is active at these intermediate conducting angles, keeping the same sum of the LED current and bleed current thereby the form of the bleed current is a saddle shape. Only around the LEL the bleeder is no longer active (resulting to the reduced flickering). The way the constant current function operates is shown in FIG. 14.

Plot 84*a* is the LED current for a 60 degree cut and plot 84*b* is the LED current for a 90 degree cut. The constant current approach tries to stabilize the sum of LED and bleed current. Thus, in the vicinity of the maximum of the LED current the bleeding current reaches its local minimum. However this behavior is not beneficial as already stated before. The corresponding bleed currents are shown as 82*a* and 82*b*. The corresponding rectified phase cut mains voltages are shown as 86*a* and 86*b* and the corresponding switching signals are shown as 88*a* and 88*b*.

Since the constant current function cannot easily can be deactivated in the above approach, a slight modification to compensate for this can, if desired, be implemented.

Figure 15:
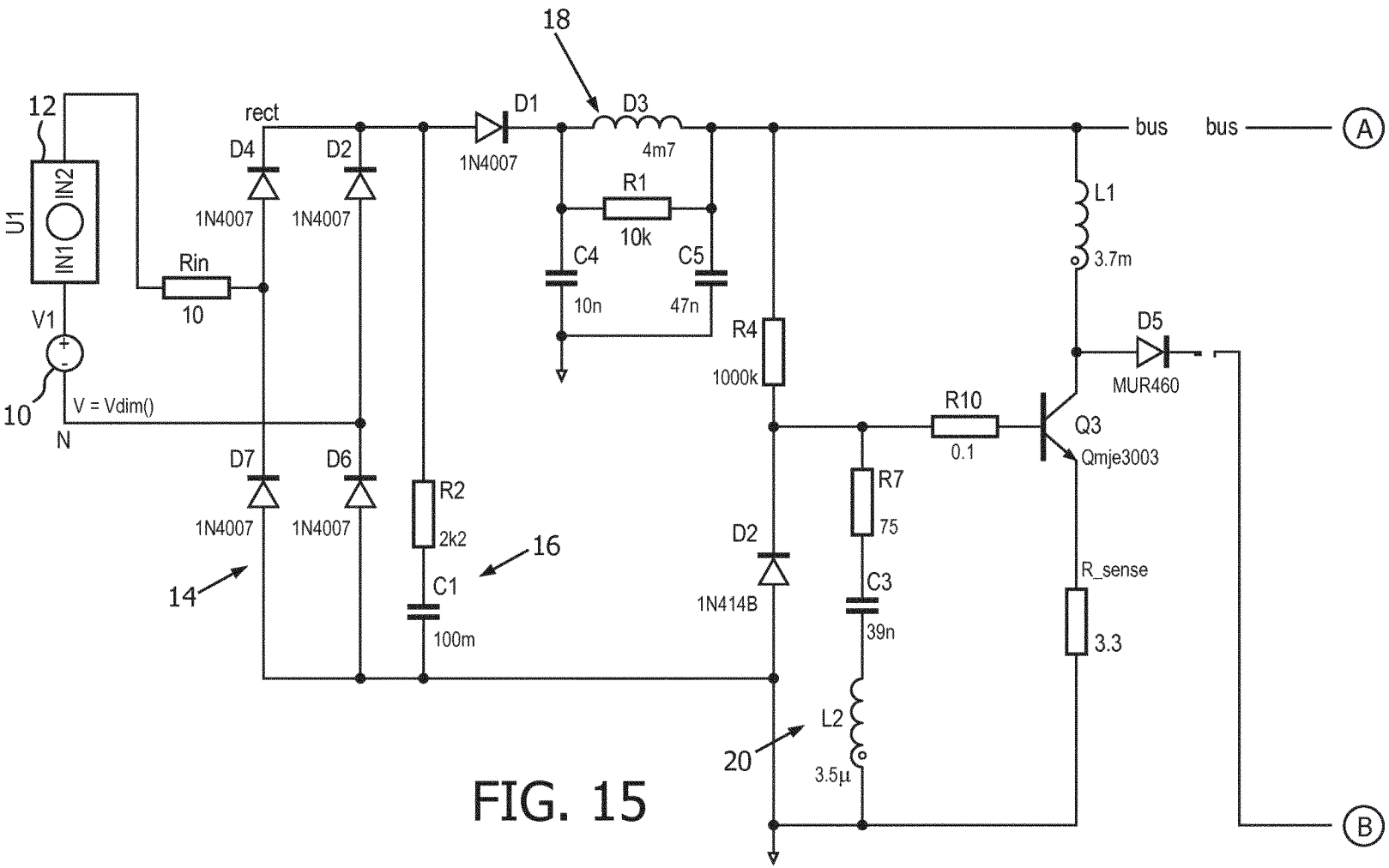
FIG. 15 shows a third example of converter circuit.
Figure 15:
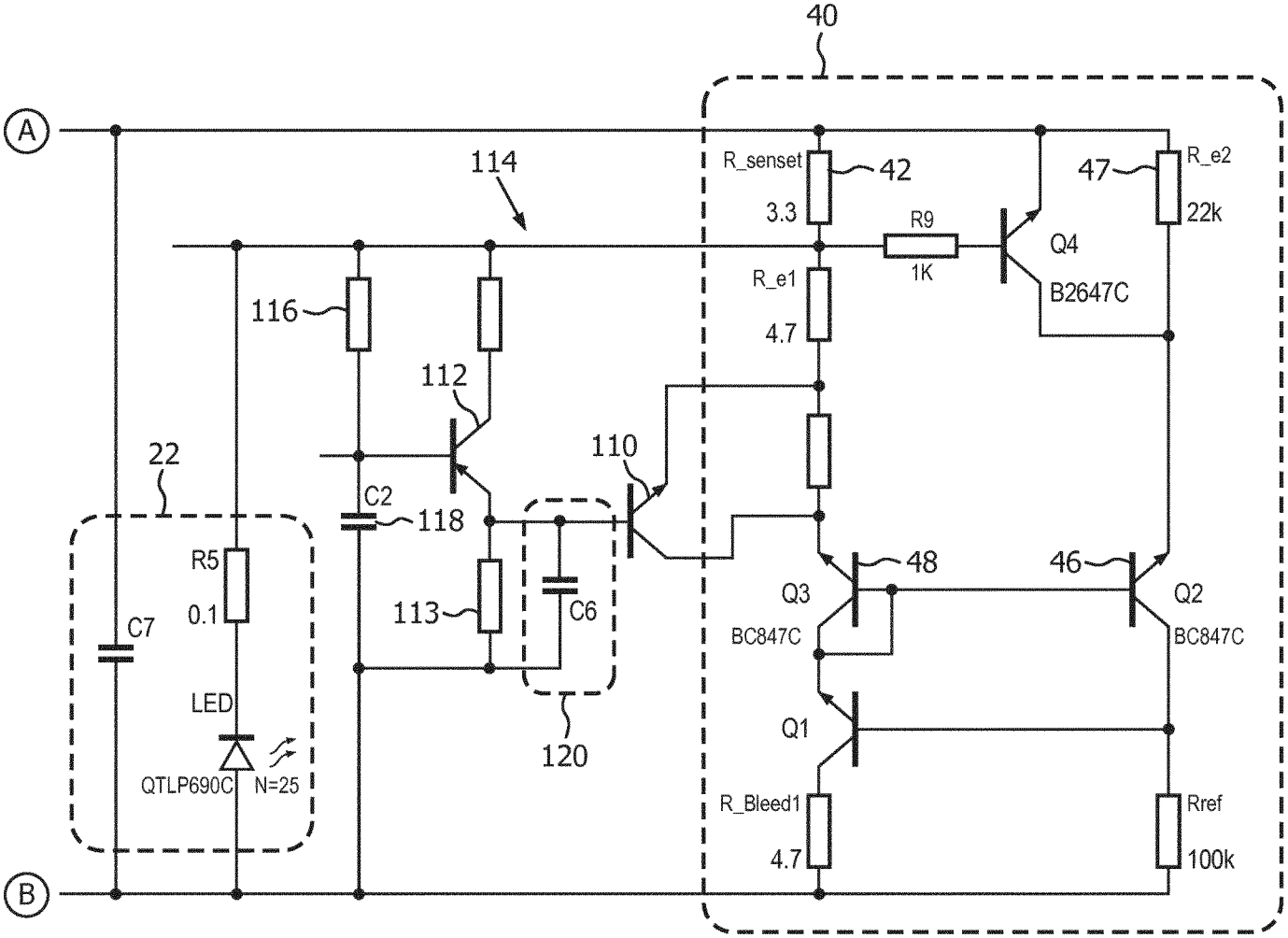

A modification to the circuit of FIG. 11 is shown in FIG. 15, in which the high level bleeding time is shortened, resulting in a flattened discharge behavior of the smoothing capacitor. There is a subcircuit coupled to the switching arrangement, adapted for disabling the switching arrangement from shorting the resistor ahead of the end of the second phase by a certain time duration. The end of the high level bleeding is advanced and the second/last peak of the saddle bleed current is removed, thus the LED current will not be as steep as before and has a more flat shape, thereby the flickering is reduced.

This subcircuit can be realized by a parallel capacitor 120 which is added to the base resistor 113 of the switching transistor 112. This enables the on time of the switching transistor to be reduced and is finally defined by the time constant given by the capacitor 120 and the base resistor 113. The base current of the transistor 110 is no longer determined only by its base resistance. Instead, an AC ripple current is present, and part of this ripple has current flowing to the capacitor, thereby preventing current flowing to the base of the transistor.

In this design the smoothing capacitor may be both charged and discharged during the second phase of the driving signal, and the bleeder circuit further comprises a filtering element between the peak detector and the switching arrangement for shortening the duration of high bleed in the second phase of the driving signal.

Figure 16:
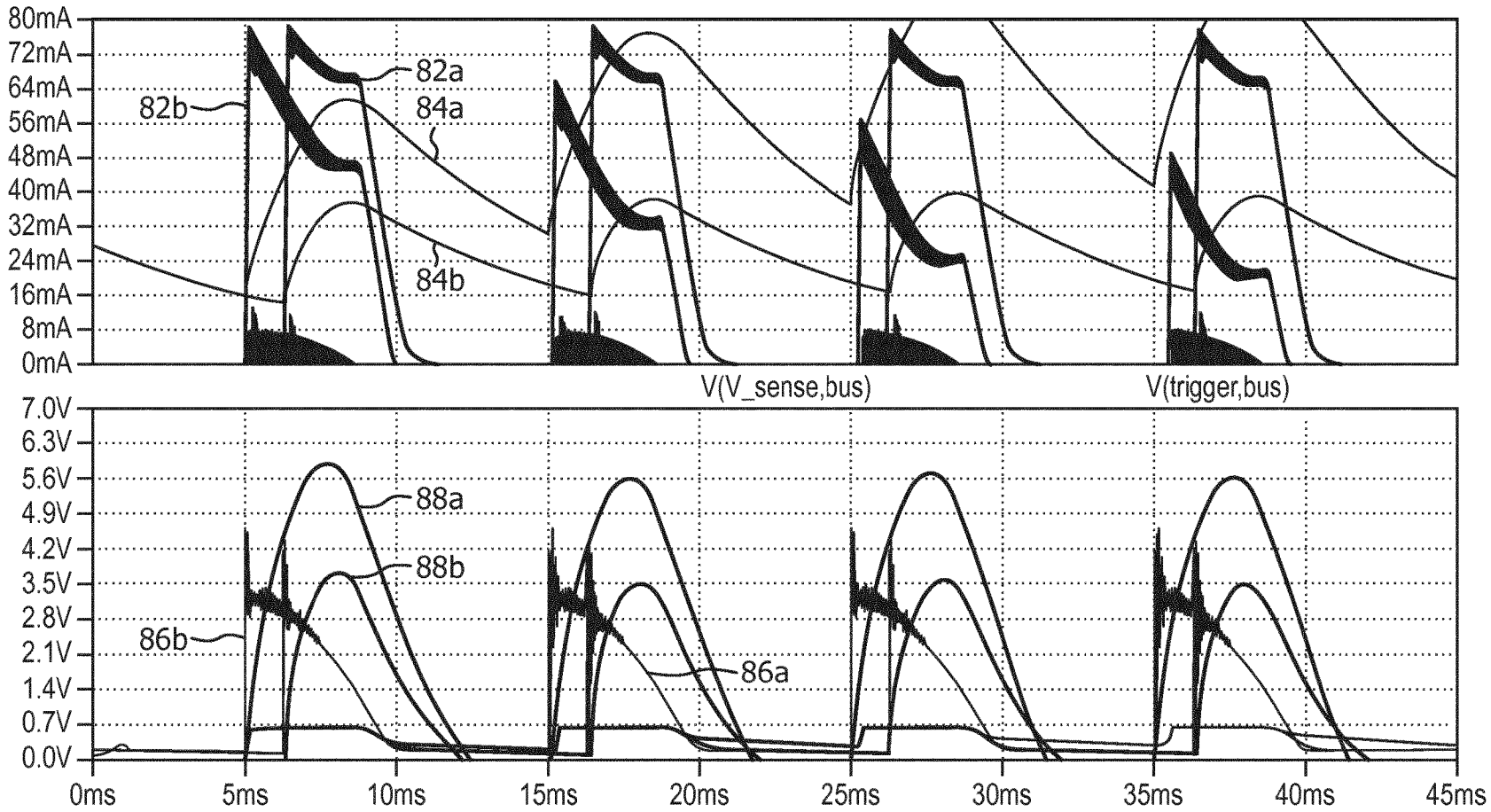
FIG. 16 provides analysis of the functioning of the converter of FIG. 15 for two different phase angles.

The corresponding performance is shown in FIG. 16 where corresponding plots as in FIG. 14 are given the same references. The shortened on time of the high level bleeding mode can be observed, resulting in the required smoother discharge of the smoothing capacitor. As shown in FIG. 16, the high level bleeding is terminated before the second peak of the bleeding current. This is caused by the addition of the capacitor 120.

Figure 17:
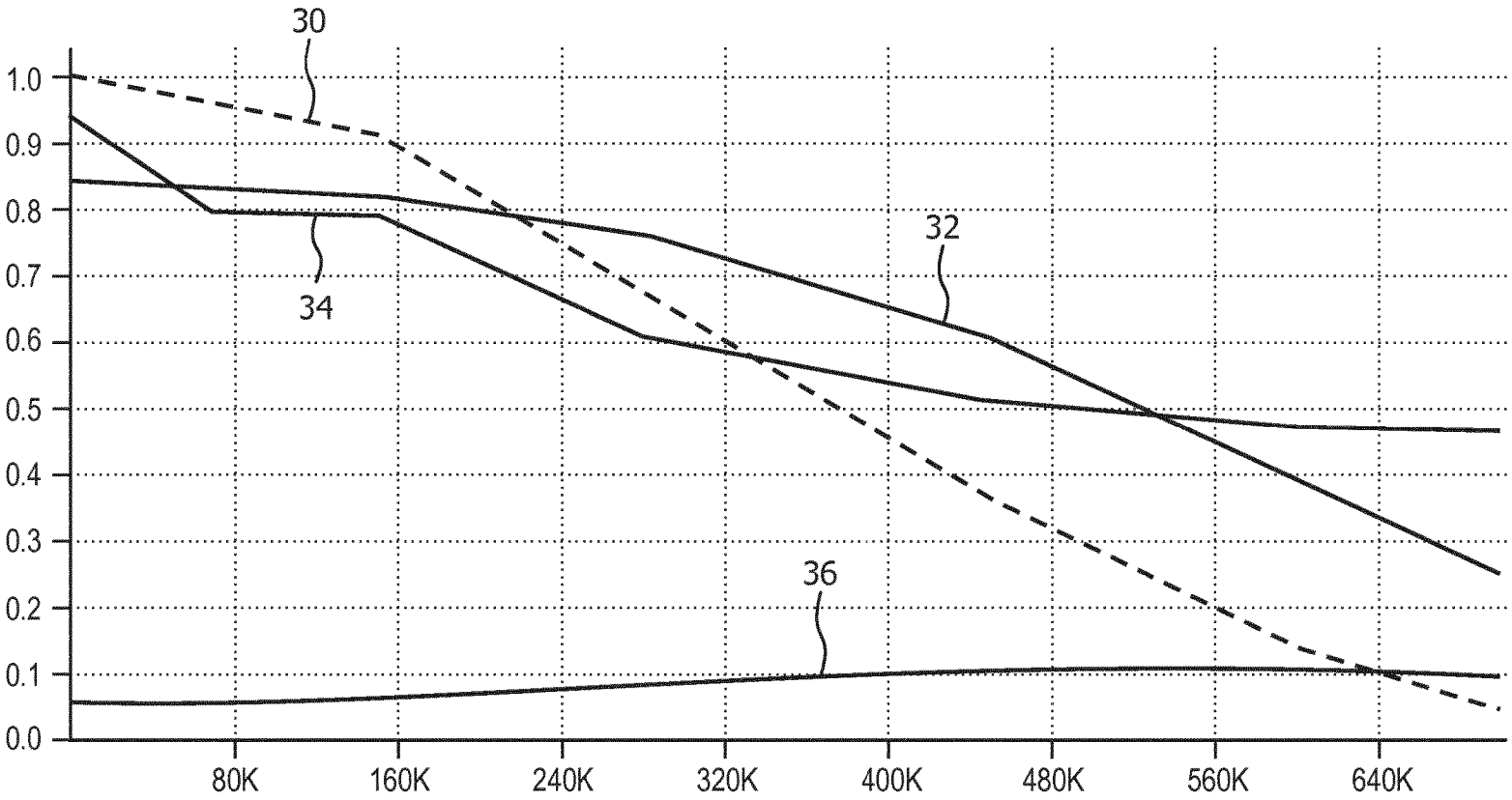
FIG. 17 shows the performance in terms of LED current, efficiency, power factor and flicker response for the circuit of FIG. 15.

The performance data for this circuit are presented in FIG. 17.

As in FIG. 2, plot 30 is the LED power, plot 32 is the efficiency, plot 36 is the power factor and plot 38 is the level of flickering.

A clear improvement of the flickering performance can be observed, the local maximum between 90° to 60° has very much reduced, in fact almost disappeared. The flickering stays below 11% during the whole dimming range.

The solutions above perform better at even lower costs and required board space (due to using less components).

Figure 18:
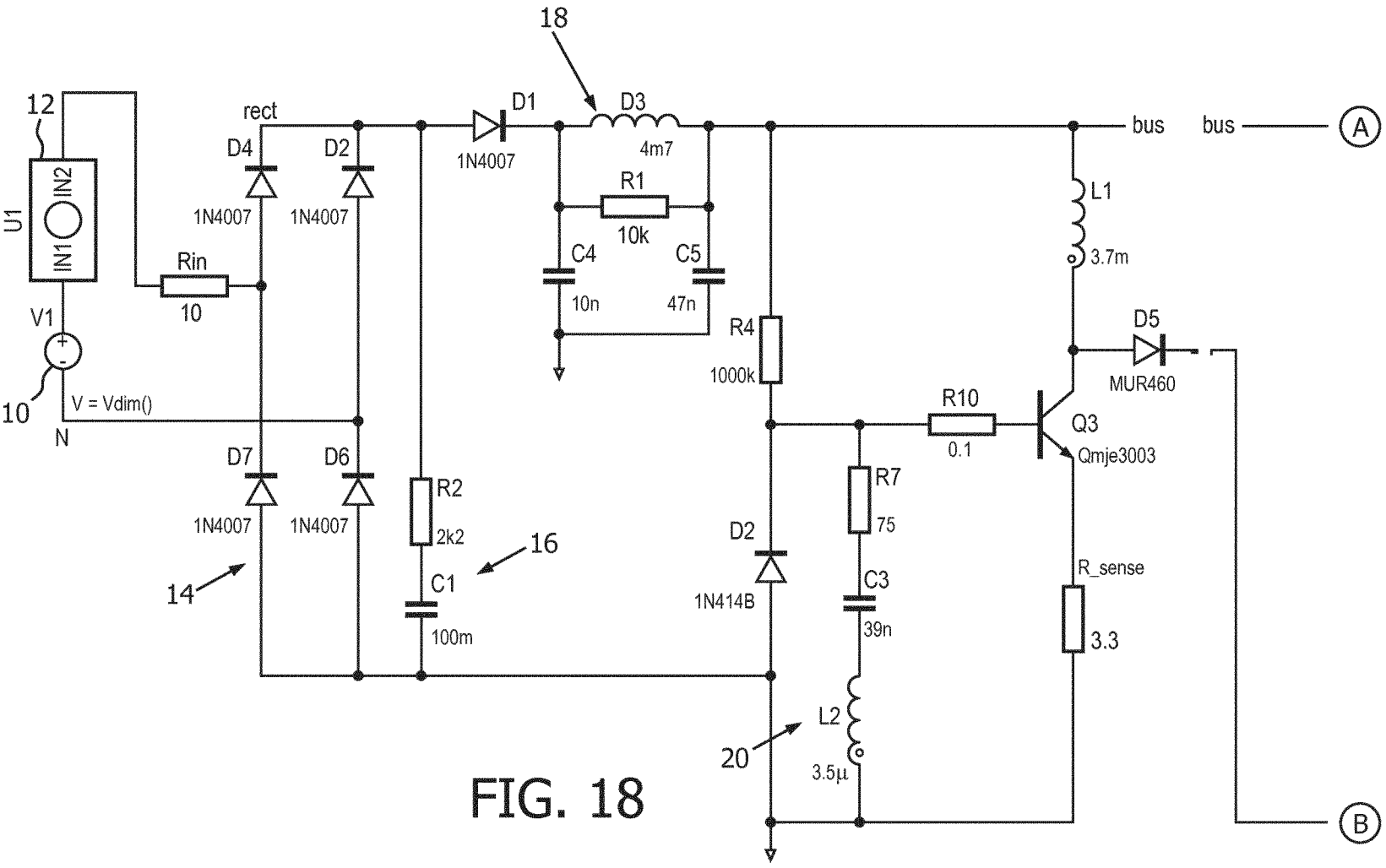
FIG. 18 shows a fourth example of converter circuit.
Figure 18:
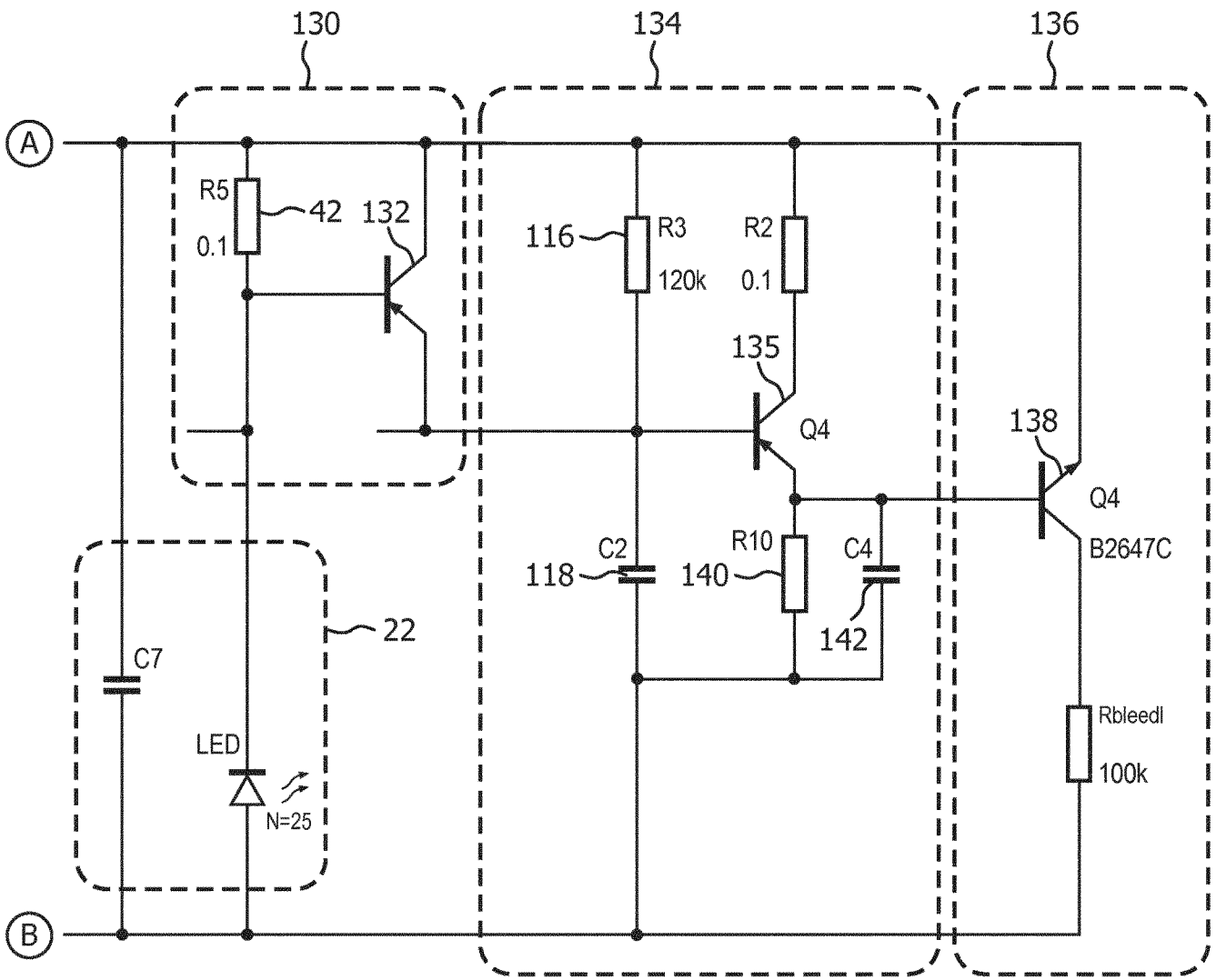

FIG. 18 shows one complete circuit example which includes some simplifications compared to the previous circuits to reduce the component count.

Basically there are three functional parts, already used and discussed above.

An activator circuit 130 based on transistor 132 is used to activate the whole modulated bleeder circuit, if the LED current is below a certain limit defined by the voltage drop across the sense resistor 42. If the sensed voltage is high enough, the transistor 132 is conducting, deactivating the bleeder by shorting the resistor of an RC detector 116,118.

A control stage 134 includes the RC detector 116,118, and based on an amplified signal from the RC detector, the control information for the activation of the bleeder circuit 136 is derived.

The bleeder circuit 136 functions as a current bleed branch and has a main transistor 138.

An RC circuit 140,142 at the base of the bleeding transistor 138 enables the bleeding time to be reduced.

Figure 19:
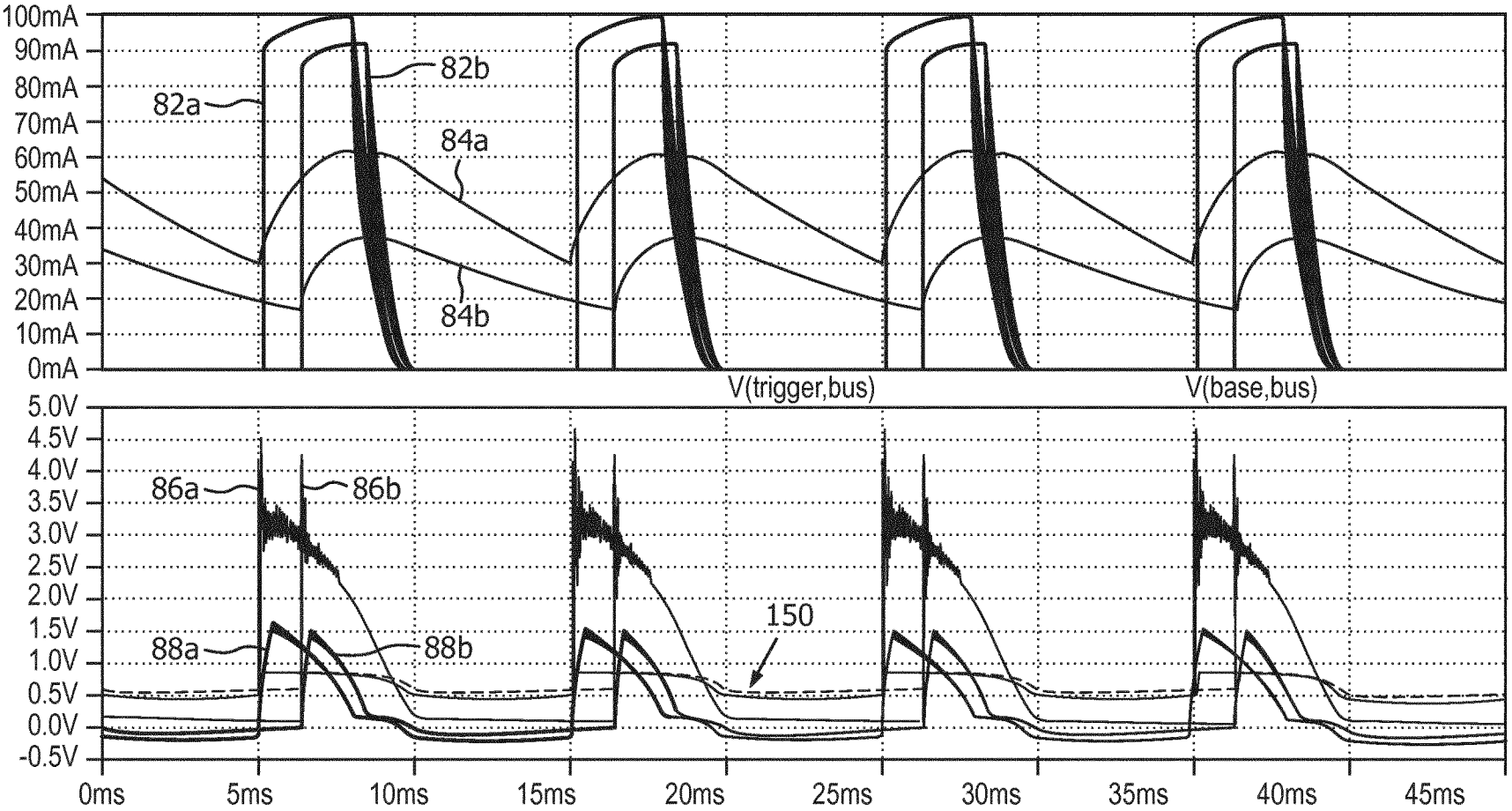
FIG. 19 provides analysis of the functioning of the converter of FIG. 18 for two different phase angles.

FIG. 19 shows waveforms for the circuit of FIG. 18, corresponding to those in FIGS. 14 and 16. Thus, plot 84*a* is the LED current for a 60 degree cut and plot 84*b* is the LED current for a 90 degree cut. The corresponding bleed currents are shown as 82*a* and 82*b*. The corresponding rectified phase cut mains voltages are shown as 86*a* and 86*b* and the corresponding switching signals are shown as 88*a* and 88*b*.

FIG. 19 additionally shows the bleeder circuit control input (for the two phase angles) as signals 150.

FIG. 19 shows a near ideal shape of the bleed current with a flattened current shape in the vicinity of the maximum LED current.

Figure 20:
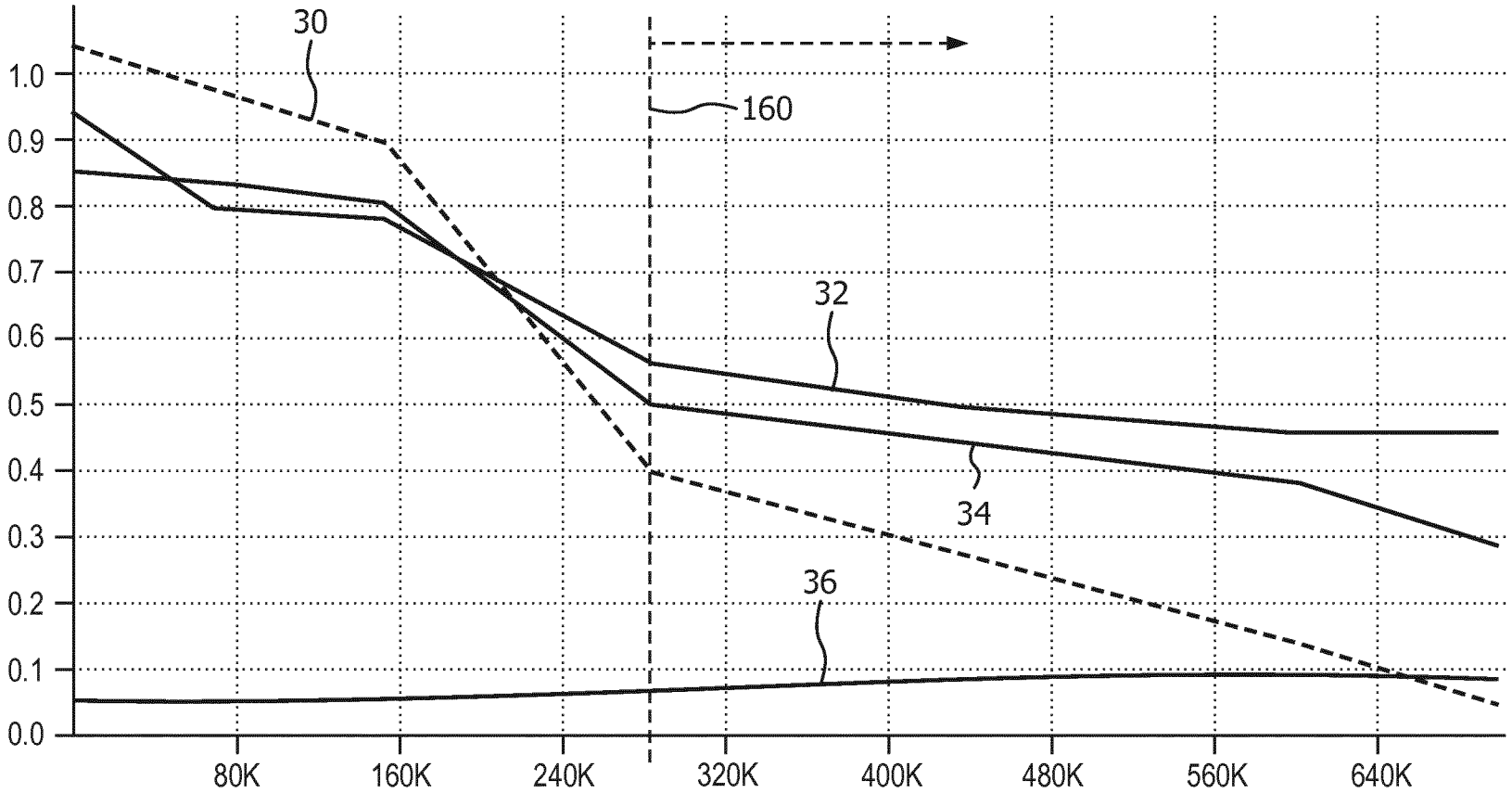
FIG. 20 shows the performance in terms of LED current, efficiency, power factor and flicker response for the circuit of FIG. 18.

FIG. 20 shows the system parameters for the circuit corresponding to FIG. 2. Thus, again plot 30 is the LED power, plot 32 is the efficiency, plot 36 is the power factor and plot 38 is the level of flickering. The bleeder is active from the line 160.

The activation of the bleeder can be tuned as a function of the voltage drop across the sense resistor (for sensing the LED current). The circuit allows a LEL of 5% (and beyond) to be reached with a flickering of 10% (and with 10.5% at a conducting angle of around 60° only slightly higher). The approach is also shown to have a negligible temperature dependency. Circuit modeling at 27° C., 75° C. and 120° C. shows a relative variation of the LED output power within this temperature range of below 1%.

Figure 21:
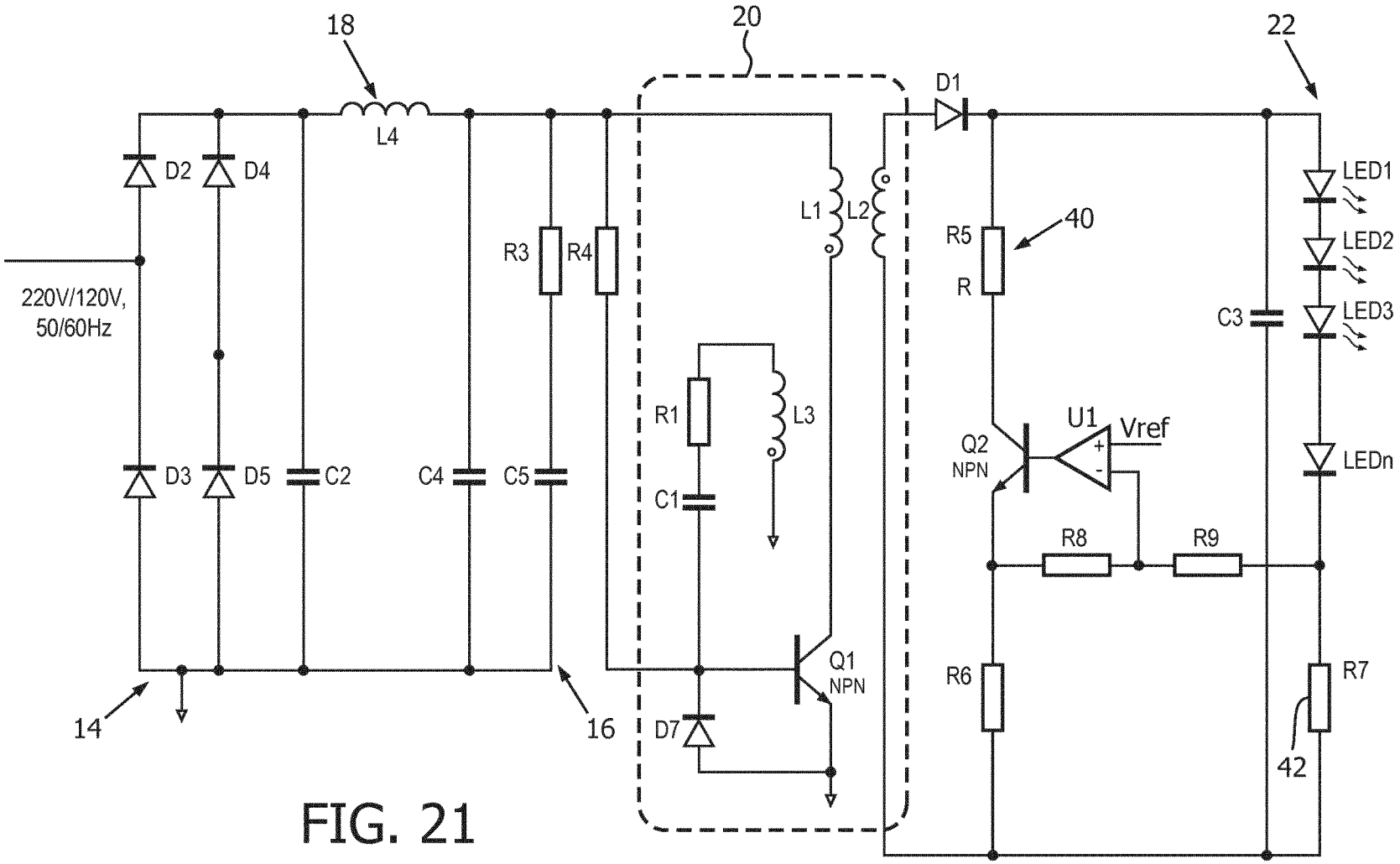
FIG. 21 shows a fifth example of converter circuit.

FIG. 21 shows a slightly different implementation of a known driver circuit including a bleeder circuit.

The same basic units are used. Thus, there is a rectifier 14, latch 16, filter 18 and RCC converter 20. This circuit shows three coupled inductors, so that there is a separate output inductor driving the LED load 22. The bleeder circuit is operated in dependence on a signal on a sense resistor 42 and comprises a comparator circuit for triggering operation of the bleed branch. As explained above, due to flicker, this type of circuit enables dimming from a minimum of around 20% without the bleeder circuit to around 5% with the bleeder circuit. The root cause of the flicker is that the bleeder circuit is controlled only according to the LED current. When deep dimming is used, a constant bleed current will be drawn both from the charging current from the power supply and from the discharging current from the smoothing capacitor. Thus, the ratio between the amplitude of the maximum and minimum LED current will increase. For example, before bleeding, the maximum LED current may be 50 mA, the minimum LED current may be 25 mA and the ratio is 2:1. When a constant bleed current of 15 mA is drawn, the maximum LED current become 35 mA, but the minimum LED current is only 10 mA, so that the ratio increases to 3.5:1, and in turn the flicker is more visible.

Figure 22:
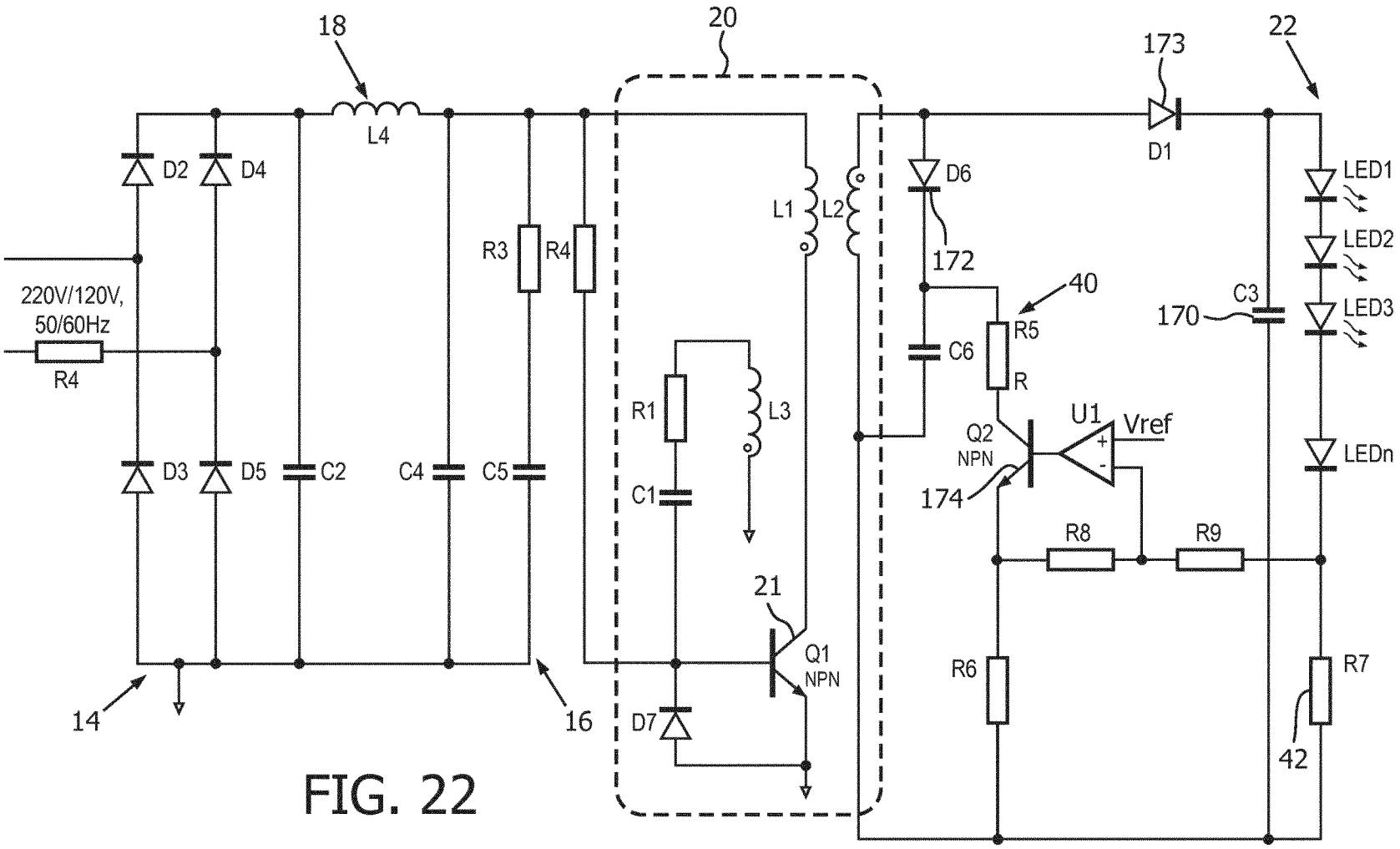
FIG. 22 shows a sixth example of converter circuit and a schematic representation of the bleed current profile.
Figure 22:
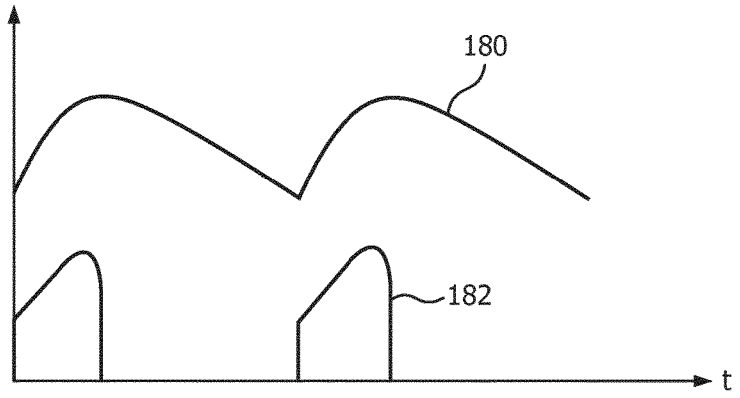

FIG. 22 shows a modification to the circuit of FIG. 21 in accordance with the teachings above. The bleeder circuit comprises a bleeding path 40 coupled to the output of the power source via a diode D6, the circuit further comprising a capacitor (C6) in parallel with the bleeding path, the bleeding path is blocked from the smoothing capacitor C3 via the decoupling diode D1, wherein the bleeder circuit further comprises a control path which is implemented as an op amp U1 in FIG. 22.

The aim is to arrange that the bleeder circuit 40 only sinks the charging current of the output smoothing capacitor 170. This has the effect of reducing the LED current ripple in the same way as explained above.

The circuit comprises a diode 172 in the bleed branch and a diode 173 between the bleed branch and the smoothing capacitor 170 and LED arrangement 22. When dimming down, the LED current also goes down, and the voltage across the sense resistor 42 decreases. When the sense resistor voltage decreased to below Vref*k (where k is a ratio defined by the resistors of the comparator circuit), the output is positive and drives the bleed transistor 174 in conduction mode. Current is then sunk through diode 172. This sink current can only happen during the active powering phase. The diode 173 prevents the operation of the bleed branch to discharge current from the output capacitor during the passive powering phase.

FIG. 22 also shows in simplified form the effect on the LED current. Plot 180 shows the LED current without the bleeder circuit. Plot 182 shows the bleed current which is diverted.

In this circuit, the LED current is sensed (i.e. after the bleed current portion is removed). In this case, the driving signal of the second phase charges said smoothing capacitor 170 and the driving signal of the first phase does not charge said smoothing capacitor 170 and allows the smoothing capacitor 170 to discharge. The circuit includes a switching arrangement in the form of a decoupling diode 173 between the bleeder circuit 40 and the smoothing capacitor 170 to prevent the bleeder circuit from bleeding discharged current from the smoothing capacitor in the first (passive powering) phase. As in the examples above, this has the result that the size of the bleed portion is on average higher during the second (active powering) phase than during the first (passive powering) phase.

Figure 23:
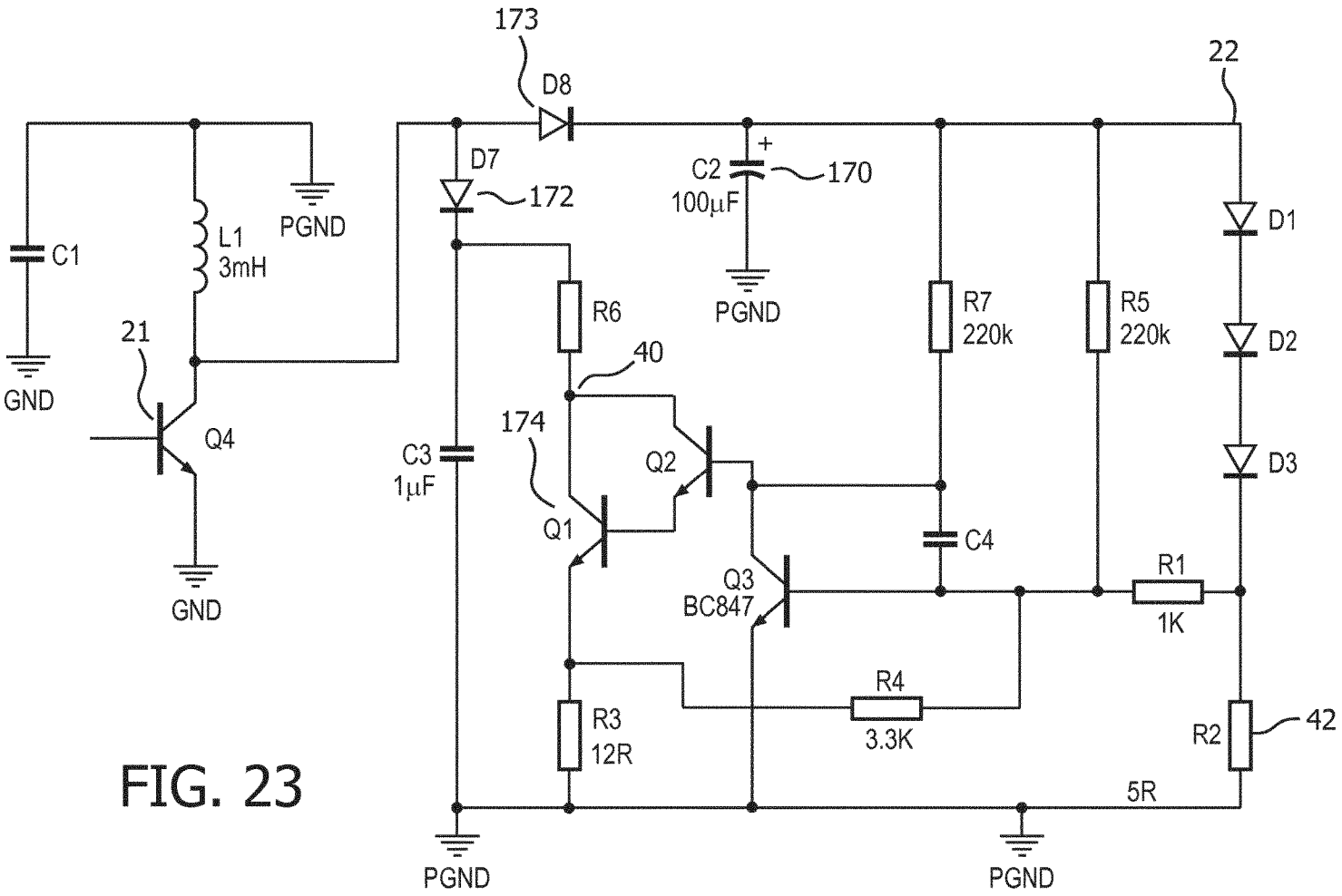
FIG. 23 shows a variation of the sixth example of converter circuit.

FIG. 23 shows a variation of the circuit in FIG. 22. The converter in FIG. 23 is a non-isolated boost converter. Components in the embodiment of FIG. 23 that are essentially similar with those in FIG. 22 use the same reference signs. In FIG. 23, discrete components are used for implement the control circuit to replace the op amp U1 in FIG. 22. The bleeding path is formed by the transistor 174, and the control path is the transistor Q2 coupled to the smoothing capacitor 170 and biased to turn on the transistor 174. The control circuit is implemented by the transistor Q3 which is turned on in case the voltage on the sensing resistor 42 is above a threshold and in turn shunts the control path, which in further turn switches off the transistor Q2 and the transistor 174. The resistor R3 can sense the bleed portion and gives a feedback to the control circuit so as to regulate the bleed portion.

Figure 24:
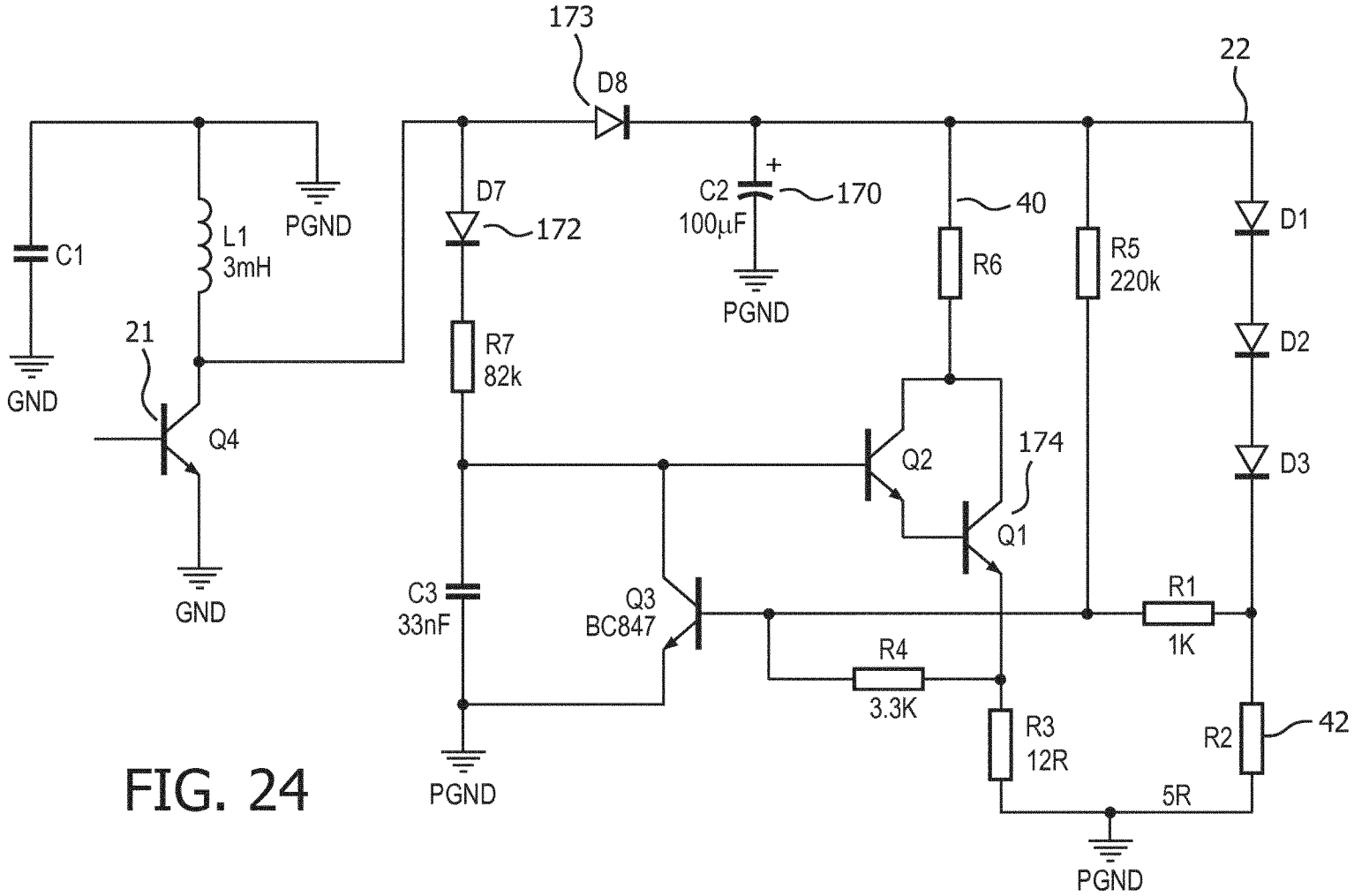
FIG. 24 shows another variation of the sixth example of converter circuit.

FIG. 24 shows a variation of the circuits in FIGS. 22 and 23. The converter in FIG. 24 is a non-isolated boost converter. Components in the embodiment of FIG. 23 that are essentially similar with those in FIGS. 22 and 23 use the same reference signs. The bleeding path is formed by the transistor 174 in parallel with the smoothing capacitor 170 and the LED arrangement 22. The control path of the bleeder circuit is the transistor Q2 coupled to output of the power source and biased to turn on the transistor 174. The control path is further blocked from the smoothing capacitor 170 via the decoupling diode 173.

The switch Q3 implementing the control circuit is adapted:

to turn on to shunt the control path so as to disable the bleeder circuit when the sensed LED arrangement current is less than the threshold;

to turn off so as to enable the bleeder circuit when the sensed LED arrangement current is bigger than an upper limit; and further to operate in linear region when the sensed LED arrangement current is between the threshold and the upper limit.

The preferable linear region could provide a smooth transition between no dimming and deep dimming thus is more user-friendly.

Figure 25:
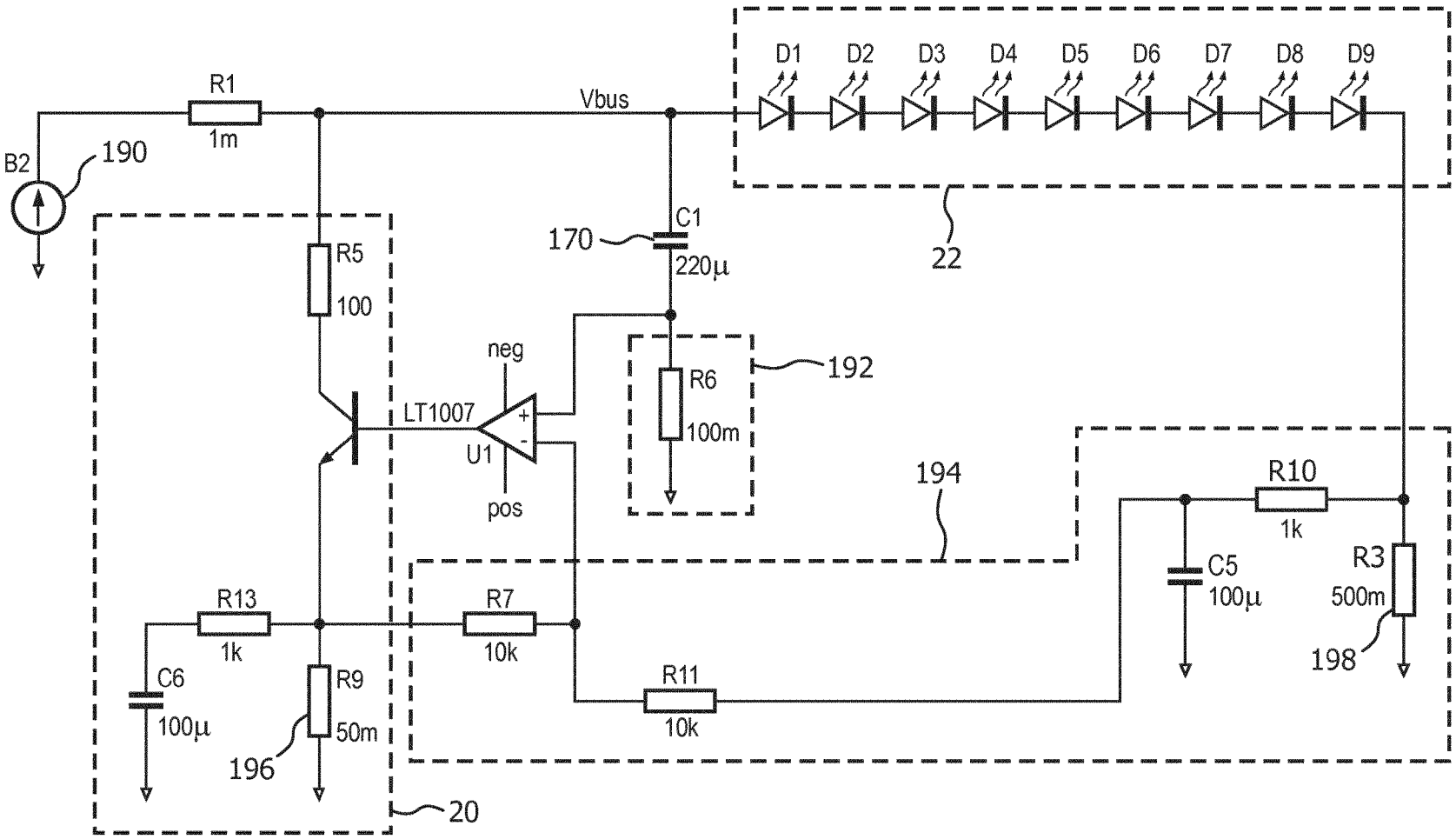
FIG. 25 shows a seventh example of converter circuit.

FIG. 25 shows another approach in accordance with an example of the invention.

The input side (mains input, rectifier and filters) are represented as a current source 190. For all examples of the invention, the implementation is independent of the actual topology of the preceding converter, and the output of the converter can simply be considered to be a current source.

The LED output 22 is shown as a string of LEDs, and the bleeder circuit 20 again drains a current portion when activated before it reaches the LED output 22.

The root cause for the undesirable AC component in the LED current is the AC component in the output capacitor voltage. Due to the parallel connection of the capacitor and LED string, voltage changes are translated into current changes via the V/I curve of the LED.

The AC component in the voltage can be reduced by directly manipulating the charging current of the capacitor.

The circuit has a first measurement unit 192 which detects the current through the smoothing output capacitor 170. In dependence on that current, the bleed current is derived. The bleed current can for example be higher than the capacitor current.

Since the bleeder function is only required when the lamp is dimmed, a second measurement unit 194 is used to determine the average power. This signal gradually reduces the bleed current with increasing average power.

The bleeder circuit forms a lossy current sink. Ignoring the feedback signal from the second measurement unit 194, any positive voltage at the first measurement unit 192 (arising from charging of the output capacitor) is copied to the bleed resistor 196. The current flowing in the bleed branch can be a ratio of this charging current, for example double. The ratio can easily be set by the ratio of the resistors in the circuit.

Most of the current will then form a collector current for the bleeder circuit transistor, which is consumed from the bus voltage. The resistor 196 of the bleeder circuit is used to shift some of the losses out of the transistor.

Hence, any charging current into the capacitor 170 will result in a lossy current in the bleeder circuit. In this way only a part of the current from the converter is available to the LED string. This, on average, reduces the average light output. With the input signal to the bleeder control stage being the capacitor current, the period in time where the bleed current is consumed corresponds only to the charging period of the capacitor, in the same way as for the example of FIG. 22. This again minimizes the voltage ripple across the output capacitor 170. No bleed current is formed during the discharge period.

The bleeder function is only required during dimming. The second measurement circuit 194 provides current measurement in the LED string via resistor 198. A filtered version of the signal on this resistor is superimposed on the signal controlling the bleeder function (by means of the comparator circuit) and this gradually blocks the bleeding function with increasing power. At full power, there is no impact from the bleeder. The ratio of resistance used in the circuit determines the power level (LED current) at which no bleeding action is performed. There is a gradual activation and deactivation of the bleeder function.

With extra components (resistors, diodes, Zener diodes) the dimming curve can also be influenced.

The circuit of FIG. 23 essentially uses a sensor 192 to sense the current flowing to the capacitor and for activating the bleeder circuit only when a charging capacitor current is flowing in the second phase.

It will be seen that all of the examples above share the same conceptual approach of adapting the size of the bleed current portion to be dependent on the phase of the driving signal. This may or may not be a phase cut mains signal. However, the bleed current portion, is controlled to be higher on average during a driving phase when energy is actively being provided to the load, for example from an power converter, compared to a passive driving phase when only capacitively stored energy is being delivered to the load. This active driving phase is when the LED current is maximum and therefore higher on average than during the passive phase.

The invention can be used in all dimmable (but also non-dimmable) light sources based on LED or OLED (and PLED, AMOLED etc.). Further, LED-based lamps with different dim tones can be extended by the proposed method and circuit(s) in order to vary the current distribution between warm white LEDs and cold white LEDs. In addition, the usage is also possible in other conventional lamps such as e.g. incandescent or fluorescent/gas discharge lamps where the driver of the lamps delivers more power as required by a lamp to reduce its output power (light).

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A driver circuit adapted to drive an LED arrangement, comprising:

a power source for providing the LED arrangement with a driving current, said power source being adapted to convert a dimmed input power into said driving current;

a current sensing element in series with the LED arrangement and adapted to sense an LED arrangement current through the LED arrangement;

a bleeder circuit having a bleeding path connected in parallel with the LED arrangement, adapted for removing a bleed portion from the driving current so as to decrease the output power of the LED arrangement; and a control circuit for enabling said bleeder circuit when the LED arrangement current sensed by the current sensing element is below a threshold so as to further dim the LED arrangement down; and the driver circuit further comprises:

a smoothing capacitor for connection across the LED arrangement;

wherein the power source is adapted to provide said driving current in a second phase charging said smoothing capacitor and in a first phase not charging said smoothing capacitor and allowing the smoothing capacitor to discharge; and wherein said control circuit is adapted for deactivating the bleeder circuit when a charging capacitor current is not flowing in the first phase.

2. The driver circuit as claimed in claim 1, wherein the resistance tuning circuit comprises a switching arrangement, wherein:

the switching arrangement is coupled to the current setting branch and is used to:

switch a parallel resistor into the current setting branch to decrease the emitter resistance of the current setting branch thereby achieving low bleed current when the rectified mains power is cut to zero;

switch the parallel resistor out of the current setting branch to increase the emitter resistance of the current setting branch thereby achieving high bleed current when the rectified mains power is uncut;

or the switching arrangement is coupled to the current bleed branch and is used to:

short circuit at least part of the emitter resistance of the current bleed branch thereby achieving high bleed current when the rectified mains power is uncut;

maintain the emitter resistance of the current bleed branch thereby achieving low bleed current when the rectified mains power is cut to zero;

and wherein the input power is a phase cut mains voltage, the first phase corresponds to phase cut duration of the input power and the second phase corresponds to phase uncut duration of the input power.

3. The driver circuit as claimed in claim 1, comprising a peak detector coupled to the sense resistor arrangement for detecting the phase of the driving current, wherein said peak detector is adapted to detect that the driving current is increasing, and enable the switching arrangement for shorting a resistor in an emitter path of the current setting branch thereby achieving high bleed current when the drive current is increasing, and the bleeder circuit further comprises a time delay circuit which is adapted to act, after a certain time delay with respect to the detection of the driving current is increasing, to disable the switching arrangement from shorting the resistor.

4. The driver circuit as claimed in claim 3, further comprising:

a smoothing capacitor for connection across the LED arrangement and providing a smoothed drive voltage to the LED arrangement, and the time delay circuit comprises a subcircuit with a capacitor coupled to a base of the switching arrangement which is a bipolar transistor.

5. The driver circuit as claimed in claim 1, wherein the sense resistor arrangement comprises first and second resistors in series, and a shorting arrangement for shorting one of the resistors in dependence on the driving current above a value.

6. The driver circuit as claimed in claim 5, comprising a detector for detecting the driving current, and for turning off the bleeder circuit when the driving current exceeds the threshold.

7. A lighting circuit, comprising:

The driver circuit as claimed in claim 1; and

The LED arrangement driven by said driver circuit.

8. The driver according to claim 1, further comprises a switching arrangement in the form of a decoupling diode between the bleeder circuit and the smoothing capacitor to prevent the bleeder circuit from bleeding discharged current from the smoothing capacitor in the first phase, said decoupling diode being forwarded from the bleeder circuit to the smoothing capacitor.

9. The driver circuit according to claim 8, wherein the control circuit comprises a control switch (Q3) coupled to the control path of the bleeder circuit, adapted:

to turn off and not to shunt the control path so as to enable the bleeder circuit when the sensed LED arrangement current is less than the threshold;

to turn on and to shunt the control path so as to disable the bleeder circuit when the sensed LED arrangement current is bigger than an upper limit; and further to operate in linear region when the sensed LED arrangement current is between the threshold and the upper limit;

and wherein the input power is a phase cut mains voltage, the first phase corresponds to phase cut duration of the input power and the second phase corresponds to phase uncut duration of the input power.

10. The driver circuit according to claim 1, wherein the bleeder circuit comprises a bleeding path coupled to the output of the power source via a diode, the circuit further comprising a capacitor in parallel with the bleeding path, the bleeding path is blocked from the smoothing capacitor via the decoupling diode, wherein the bleeder circuit further comprises a control path, and the smoothing capacitor is coupled to said control path.

11. The driver circuit according to claim 1, wherein the bleeding path is in parallel with the smoothing capacitor and the LED arrangement, and the bleeder circuit further comprises a control path, and the output of the power source is coupled to said control path, and the control path is blocked from the smoothing capacitor via the decoupling diode.

12. The driver circuit according to claim 1, further comprises:

a sensor for sensing the current flowing to charge the capacitor and for activating the bleeder circuit only when a charging capacitor current is flowing in the second phase charging said smoothing capacitor.

13. The driver according to claim 12, wherein the bleeder circuit further comprises:

a current sensing element, as the sensor, in series with the smoothing capacitor for sensing a charging current of the smoothing capacitor; and the control circuit comprises a comparing circuit for enabling the bleeder circuit through a comparison between the sensed charging current of the smoothing capacitor with the sensed LED arrangement current, and wherein the input power is a phase cut mains voltage, the first phase corresponds to phase cut duration of the input power and the second phase corresponds to phase uncut duration of the input power.

14. A driver circuit adapted to drive an LED arrangement, comprising:

a power source for providing the LED arrangement with a driving current, said power source being adapted to convert a dimmed input power into said driving current;

a current sensing element in series with the LED arrangement and adapted to sense an LED arrangement current through the LED arrangement;

a bleeder circuit having a bleeding path connected in parallel with the LED arrangement, adapted for removing a bleed portion from the driving current so as to decrease the output power of the LED arrangement; and a control circuit for enabling said bleeder circuit when the LED arrangement current sensed by the current sensing element is below a threshold so as to further dim the LED arrangement down;

wherein the bleeder circuit comprises:

a first branch which comprises:

a current bleed branch in parallel with said LED arrangement; and the current sensing element comprises a sense resistor arrangement having an output which is adapted to connect to the LED arrangement and to the current bleed branch, wherein the sense resistor is adapted to sense the driving current and adapted to adjust the bleed portion according to the driving current, and the bleeder circuit further comprises:

a current setting branch, for setting the bleed portion that is bled by the current bleed branch;

wherein the current bleed branch and the current setting branch form a current mirror and wherein the bleed portion of the driving current is dependent on the ratio between an emitter resistance of the current setting branch and an emitter resistance of the current bleed branch in the current mirror, and wherein the bleeder circuit further comprises:

a resistance tuning circuit:

coupled to the emitter resistance of the current setting branch and adapted to increase the emitter resistance of the current setting branch to achieve a high bleed current or decrease the emitter resistor of the current setting branch to achieve a low bleeder current, according to the phase of the driving current or the phase of a rectified mains power into the power source, or coupled to the emitter resistance of the current bleed branch, and adapted to decrease the emitter resistance of the current bleed branch to achieve a high bleed current or increase the emitter resistor of the current setting branch to achieve a low bleeder current, according to the phase of the driving current or the phase of a rectified mains power into the power source.

* * * * *